US012313334B2

(12) United States Patent
Cho et al.

(10) Patent No.: US 12,313,334 B2
(45) Date of Patent: May 27, 2025

(54) REFRIGERATOR AND HOME APPLIANCE

(71) Applicant: LG Electronics Inc., Seoul (KR)

(72) Inventors: Yonghyun Cho, Seoul (KR); Sanghyun Cheon, Seoul (KR); Changjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 193 days.

(21) Appl. No.: 18/094,685

(22) Filed: Jan. 9, 2023

(65) Prior Publication Data

US 2023/0228482 A1 Jul. 20, 2023

(30) Foreign Application Priority Data

Jan. 14, 2022 (KR) ..... 10-2022-0006021
Jan. 28, 2022 (KR) ..... 10-2022-0013729

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 29/008* (2013.01)

(58) Field of Classification Search
CPC .... F25D 29/005; F25D 23/028; F25D 29/008; F25D 23/12
See application file for complete search history.

(56) References Cited

U.S. PATENT DOCUMENTS

| | | | |
|---|---|---|---|
| 2003/0121272 A1 | 7/2003 | Kim et al. | |
| 2008/0165998 A1 | 7/2008 | LeClear et al. | |
| 2020/0003486 A1 | 1/2020 | Kim et al. | |

FOREIGN PATENT DOCUMENTS

| | | | |
|---|---|---|---|
| CN | 106839590 | 6/2017 | |
| EP | 3276287 | 1/2018 | |
| EP | 3690369 | 8/2020 | |
| EP | 3690369 A1 * | 8/2020 | ..... F25D 11/02 |
| KR | 19990041832 | 6/1999 | |
| KR | 10-2004- 0025403 | 3/2004 | |
| KR | 10-0764279 | 10/2007 | |
| KR | 101245886 | 3/2013 | |
| KR | 10-2016- 0100731 | 8/2016 | |
| KR | 20160100731 A * | 8/2016 | |
| KR | 20190084860 A * | 7/2019 | |

OTHER PUBLICATIONS

Extended European Search Report in European Appln. No. 23151266.6, mailed on May 12, 2023, 8 pages.

* cited by examiner

*Primary Examiner* — Kun Kai Ma
(74) *Attorney, Agent, or Firm* — Fish & Richardson P.C.

(57) ABSTRACT

A home appliance includes a refrigerator. The home appliance includes a cabinet configured to define a storage space with a front surface opened, a door configured to open and close the storage space, and a speaker disposed on a top surface of the cabinet and configured to communicate with an external device, where the speaker includes a sound output portion configured to output sound. The sound output portion is inclined with respect to the top surface of the cabinet.

19 Claims, 14 Drawing Sheets

REFRIGERATOR AND HOME APPLIANCE

CROSS-REFERENCE TO RELATED APPLICATIONS

The present application claims priority under 35 U.S.C. 119 and 35 U.S.C. 365 to Korean Patent Application No. 10-2022-0006021, filed on Jan. 14, 2022, and Korean Patent Application No. 10-2022-0013729, filed on Jan. 28, 2022, the disclosures of which are hereby incorporated by reference in their entirety.

BACKGROUND

The present disclosure relates to a refrigerator and a home appliance.

Recently released home appliances installed in an indoor space have various additional functions in addition to functions that are originally performed by the home appliance to improve user convenience.

Typically, a refrigerator is a home appliance capable of keeping food fresh by including a storage room for storing food and a cold air supply device for supplying cold air to the storage room.

In the case of the refrigerator according to the related art, only a function of simply storing food in a low-temperature state may be performed. However, in recent years, needs for additional functions in addition to the food storage functions are increasing.

For example, a refrigerator, in which various multimedia devices are mounted to recognize a user's voice, thereby automatically performing a desired function or to play music desired by the user through a speaker, are being released.

Korean Registered Patent Publication No. 1245886 is an invention related to "a mounting structure of a speaker of a refrigerator" and discloses a refrigerator including a speaker provided at one side of a door cap decoration defining an outer appearance of an upper portion of a refrigerator door and a speaker hole opened to correspond to a position of the speaker.

However, in the related art, when the refrigerator is disposed adjacent to furniture, like a refrigerator that is embedded in a cabinet, there is a limitation in that sound is not sufficiently transmitted to the outside, and thus, a satisfactory sound quality is not provided to the user.

In addition, the mounted speaker may be separated or damaged due to an impact while opening and closing the door to deteriorate performance of the speaker.

In addition, since it is apprehended that the speaker degrades design aesthetics of the refrigerator, there is a limitation in that a sound source output from the speaker interferes by other structures in the process of supplementing the above-described apprehension to deteriorate the performance of the speaker.

SUMMARY

Embodiments provide a home appliance capable of providing improved sound source quality to a user by improving a phenomenon in which sound output from a speaker is blocked by other components constituting a refrigerator.

Embodiments also provide a home appliance in which a speaker is fixed to a top surface of an outer case to maintain a sense of unity without impairing aesthetics of the home appliance.

Embodiments also provide a home appliance capable of maintaining performance of a speaker by minimizing an influence of the speaker due to an external impact applied to a refrigerator or vibration occurring while performing a function of the home appliance.

In one embodiment, a home appliance includes: a cabinet configured to define a storage space with a front surface opened; and a door configured to open and close the storage space, wherein a speaker device configured to communicate with an external device and including a sound output portion configured to output sound is disposed on a top surface of the cabinet, wherein the sound output portion is disposed to be inclined with respect to the top surface of the cabinet.

The speaker device may include a case configured to provide a space in which the sound output portion is accommodated, wherein the case may include an opened sound output hole at a position corresponding to a position at which the sound output portion is installed.

The sound output portion may be disposed to be inclined from an upper end to a lower end so as to be away from a front surface of the case.

The sound output hole may be defined to be inclined from an upper end to a lower end so as to be away from the front surface of the case.

A hinge device on which the door is rotatably provided may be disposed at each of both sides of the top surface of the cabinet, and the speaker device may be disposed in a space between the hinge devices so as to be spaced apart from the hinge devices.

A position fixing portion may be disposed in a space in which the speaker device and the hinge device are spaced apart from each other.

In the position fixing portion, an opening may be defined in a surface facing the speaker device, and at least a portion of the speaker device is inserted into the opening, and one surface of the position fixing portion may be disposed to be in contact with one surface of the hinge device.

The case may include a first case configured to define at least a portion of a top surface of the case and is provided by coupling a second case disposed below the first case to define at least a portion of a bottom surface of the case.

The sound output hole may be defined in a front surface of the first case.

The home appliance may further include a microphone mounting portion which is provided on a top surface of the door, on which a microphone module is mounted, and in which a microphone hole is defined, wherein the microphone mounting portion and the speaker device may not be disposed on the same lines in a left and right direction.

The microphone mounting portion may be disposed at a position at which a center thereof is biased from a center to one side in the left and right direction of the cabinet, and the speaker device may be disposed at a position at which a center thereof is biased from the center to the other side in the left and right direction of the cabinet.

In the door, a left door and a right door may be disposed side by side in a pair, the microphone mounting portion may be provided on a top surface of any one door of the left door and the right door, and a center of the speaker device may be disposed closer to the door, on which the microphone mounting portion is not provided, of the left door and the right door.

The microphone mounting portion may be disposed close to one side, which is close to the hinge device, of both left and right sides of the door.

The microphone mounting portion may be disposed closer to a front end than a rear end of the door.

The microphone mounting portion may be disposed on the left door, and the speaker device may be disposed at a position at which a center thereof is biased to a right side from a center of the cabinet in the left and right direction.

The microphone mounting portion may include: a protrusion protruding upward from a top surface of the door; and an inclined portion that is inclined downward as the inclined portion extends forward from a front end of the protrusion, wherein the microphone hole may be provided in pair in the inclined portion.

A hinge cover may be disposed on the top surface of the cabinet, wherein the hinge cover may include: a front surface portion; a top surface portion bent backward from an upper end of the front surface portion to extend and a recessed portion configured to define a space, into which the speaker device is accommodated, by recessing at least a portion of the top surface portion downward.

The hinge cover may include the cover portion that is disposed in front of one side, which is adjacent to the microphone mounting portion, of both sides of the speaker device, and is disposed at a height corresponding to a vertical height of the top surface portion may be provided.

The cover portion may extend from one end of the top surface portion in a direction in which the speaker device is disposed.

The cover portion may be disposed between a front surface of the speaker device and the door and be spaced apart from the top surface portion so as to be provided in singularity or plurality.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction toward a door is defined as a front direction with respect to a cabinet shown in FIGS. 1 and 2, a direction toward the cabinet with respect to the door is defined as a rear direction, a direction toward a bottom on which a refrigerator is installed is defined as a downward direction, and a direction away from the bottom is defined as an upward direction.

Figure 1:
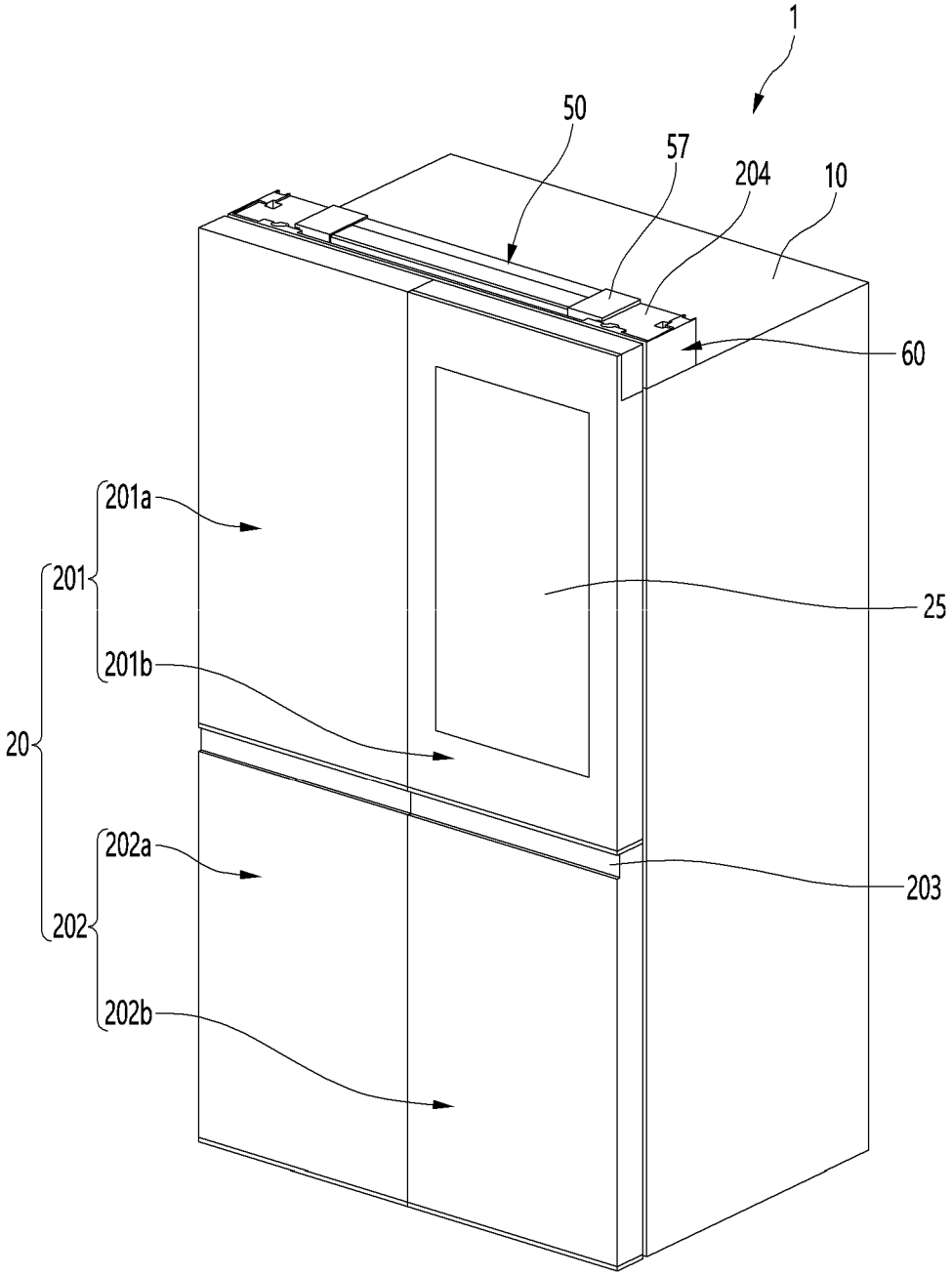
FIG. 1 is a front perspective view of a refrigerator according to an embodiment.
Figure 2:
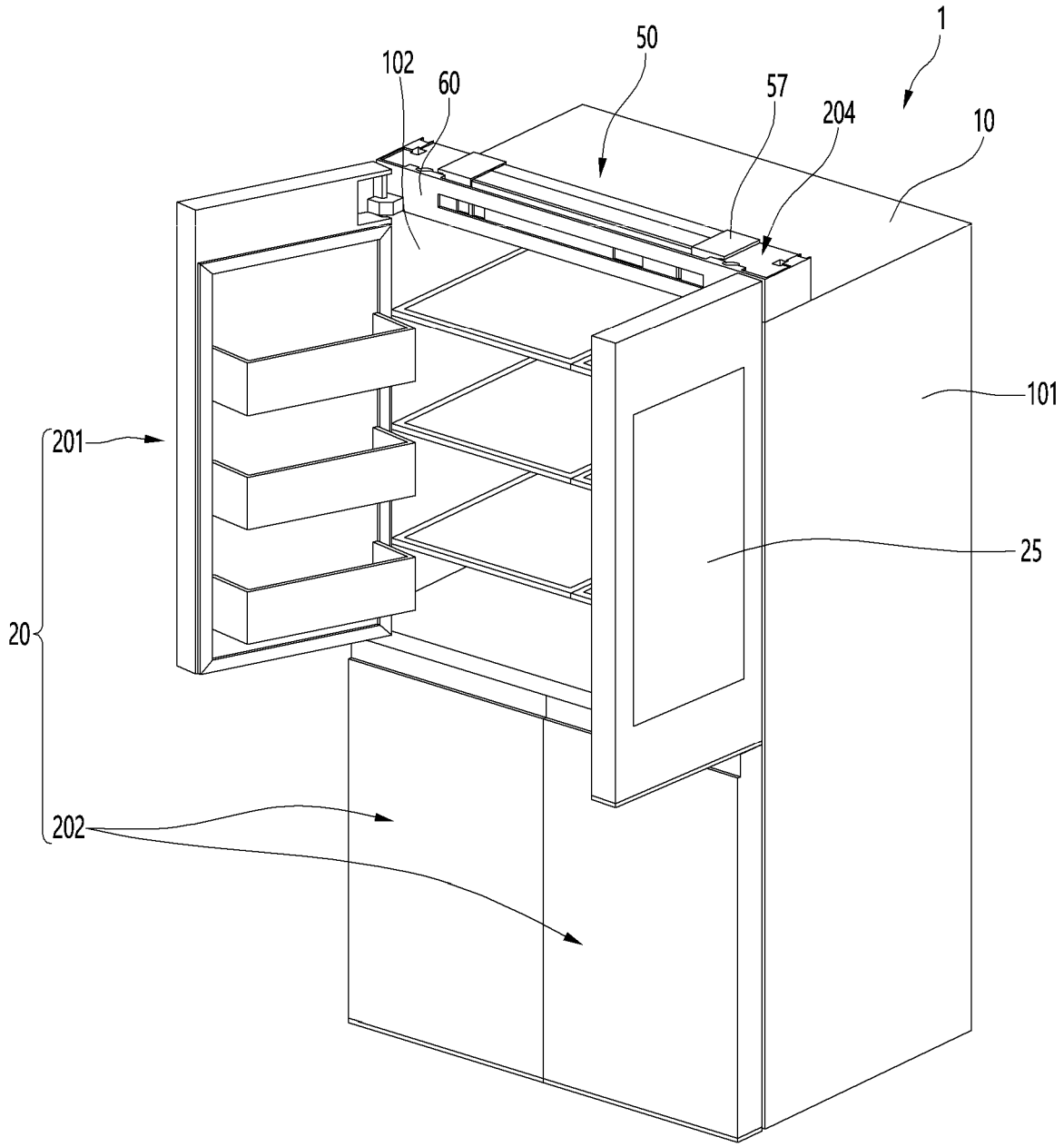
FIG. 2 is a front view illustrating a state in which a door of the refrigerator is opened.

FIG. 1 is a front perspective view of a refrigerator according to an embodiment. Also, FIG. 2 is a front view illustrating a state in which a door of the refrigerator is opened.

An outer appearance of a refrigerator 1 according to an embodiment may be defined by a cabinet 10 in which a storage space is defined, and a door 20 for opening and closing the storage space of the cabinet 10.

The cabinet 10 includes an outer case 101 defining an outer appearance of the refrigerator.

The outer case 101 may form a top surface, left and right surfaces, a rear surface, and a bottom surface of the refrigerator 1 excluding a front surface and may also define only some of the surfaces.

An inner case 102 may be disposed inside the outer case 101 to define storage spaces 11 and 12. A insulating material is filled in a space between the outer case 101 and the inner case 102.

The cabinet 10 may define a storage space that is divided vertically. The storage spaces may be divided into an upper storage space 11 and a lower storage space 12.

For example, a refrigerating compartment may be defined in the upper storage space 11. A freezing chamber may be defined in the lower storage space 12.

In addition, the freezing compartment 12 may be divided into left and right sides to define a left freezing chamber 12*a* and a right freezing chamber 12*b*. The left freezing compartment 12*a* may be referred to as a left lower storage space, and the right freezing compartment 12*b* may be referred to as a right lower storage space.

The door 20 may be configured to open and close the upper storage space 11 and the lower storage space 12, respectively. For example, the door 20 may be rotatably mounted to the cabinet 10, and each of the upper storage space 11 and the lower storage space 12 may be opened and closed by the rotation. Of course, the door 20 may also be withdrawn to open and close each of the refrigerating compartment and the freezing compartment.

The door 20 may include a refrigerating compartment door 201 that opens and closes the refrigerating compartment 11 and a freezing compartment door 202 that opens and closes the freezing compartment. The refrigerating compartment door 201 may be referred to as an upper door, and the freezing compartment door 202 may be referred to as a lower door.

The refrigerating compartment door 201 may include a pair of a left refrigerating compartment door and a right refrigerating compartment door, which are arranged side by side. The left refrigerating compartment door 201*a* and the right refrigerating compartment door 201*b* may be disposed adjacent to each other and may have the same size. In addition, the left refrigerating compartment door 201*a* and the right refrigerating compartment door 201*b* may independently rotate to open and close the refrigerating compartment 11.

Upper and lower ends of the refrigerating compartment door 201*a* and the freezing compartment door 201*b* may be coupled to the cabinet 10 by hinge devices 204 and 205, respectively. The hinge devices 204 may include an upper hinge 204 and a lower hinge 205, and the refrigerating compartment door 201*a* and the freezing compartment door 201*b* may be rotatably mounted thereon.

In addition, the freezing compartment door 202 may include a pair of a left freezing compartment door 202*a* and a right freezing compartment door 202*b*, which are arranged side by side. In addition, the left freezing compartment door 202*a* and the right freezing compartment door 202*b* may independently rotate to open and close the freezing compartment. The left freezing compartment door 202*a* and the right freezing compartment door 202*b* may be disposed adjacent to each other and may have the same size.

Of course, although the refrigerator having a structure in which a refrigerating compartment 11 is disposed at an upper side, and a freezing compartment 12 is disposed at a lower side is described as an example in the embodiment, the present disclosure may be applied to all types of refrigerators equipped with a door without being limited to types of refrigerators.

An outer appearance of the front surface of the refrigerator 1 may be defined in the state in which the door 20 is closed and may define the out appearance of the refrigerator 1 viewed from the front in the state in which the refrigerator 1 is installed.

The right refrigerating compartment door may have a structure capable of seeing through the refrigerator interior space.

For example, the door 20 may include a door body 21 defining an overall shape of the door 20. In addition, the door body 21 may be provided with a see-through assembly 25 capable of seeing through a space behind the door 20. A front surface of the door body 21 may have a structure through which the see-through assembly 25 is seen.

In an embodiment, one see-through door is described as an example, but a plurality of see-through doors may be provided. Also, the see-through door may be defined at a position other than the right refrigerating compartment door.

The lower door 202 may be provided with a handle portion 203 that is recessed inward at an upper portion and may be gripped by a user.

According to an embodiment, sound is output from the refrigerator 1. The sound may be output from a speaker device 50 mounted on the top surface of the refrigerator 1.

This speaker device 50 is installed on the top surface of the refrigerator. In detail, the speaker device 50 may be provided between the hinge devices 204. The speaker device 50 may be covered by the upper door 201. In this case, the speaker device 50 may not be visually exposed to the user from the front surface.

The speaker device 50 may be wirelessly connected to an external device 70. Such the external device 70 includes a mobile terminal such as a smart phone or a tablet provided with a wireless communication module. The user may control the speaker device 50 using the external device 70.

In an embodiment, a refrigerator 100 having a bottom freezer type, in which a refrigerating compartment is provided at an upper portion, and a freezing compartment is provided at a lower portion, is shown, but the embodiment of the present disclosure is not limited thereto. For example, the present disclosure may be applied to a top mount type refrigerator in which the freezing compartment is disposed above the refrigerating compartment, a side-by-side type refrigerator in which the refrigerating compartment and the freezing compartment are disposed at left and right sides, and the like.

Figure 3:
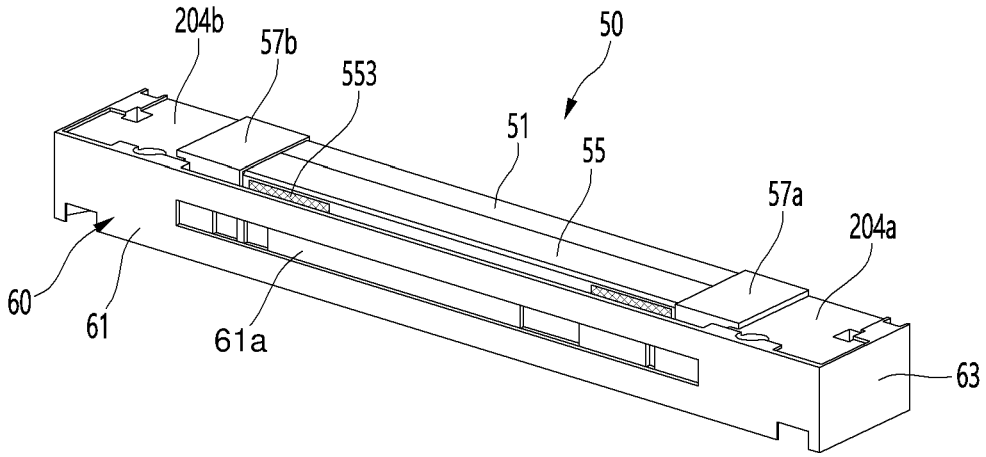
FIG. 3 is a front perspective view of a speaker device according to an embodiment.
Figure 4:
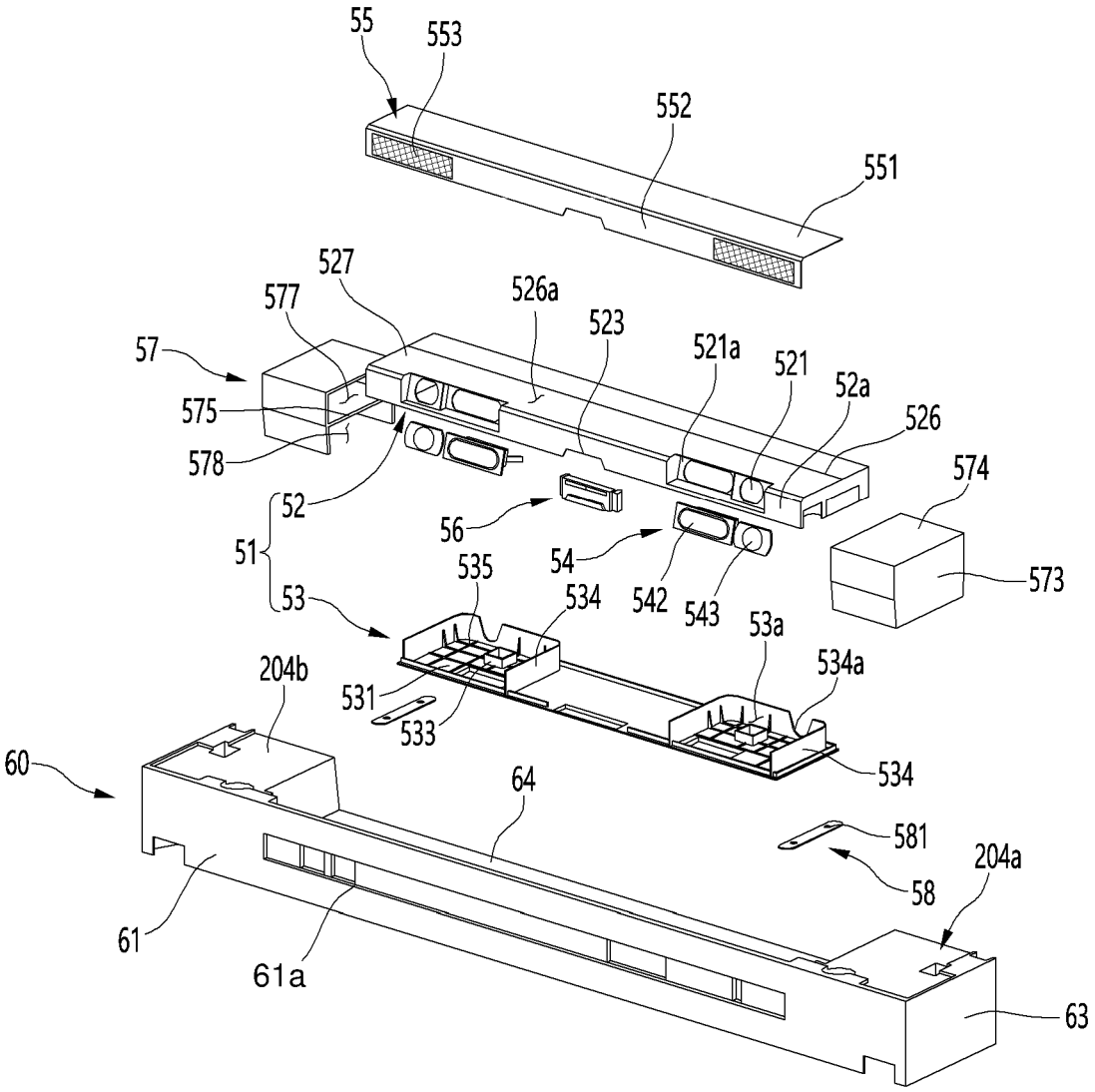
FIG. 4 is an exploded front perspective view of the speaker device.
Figure 5:
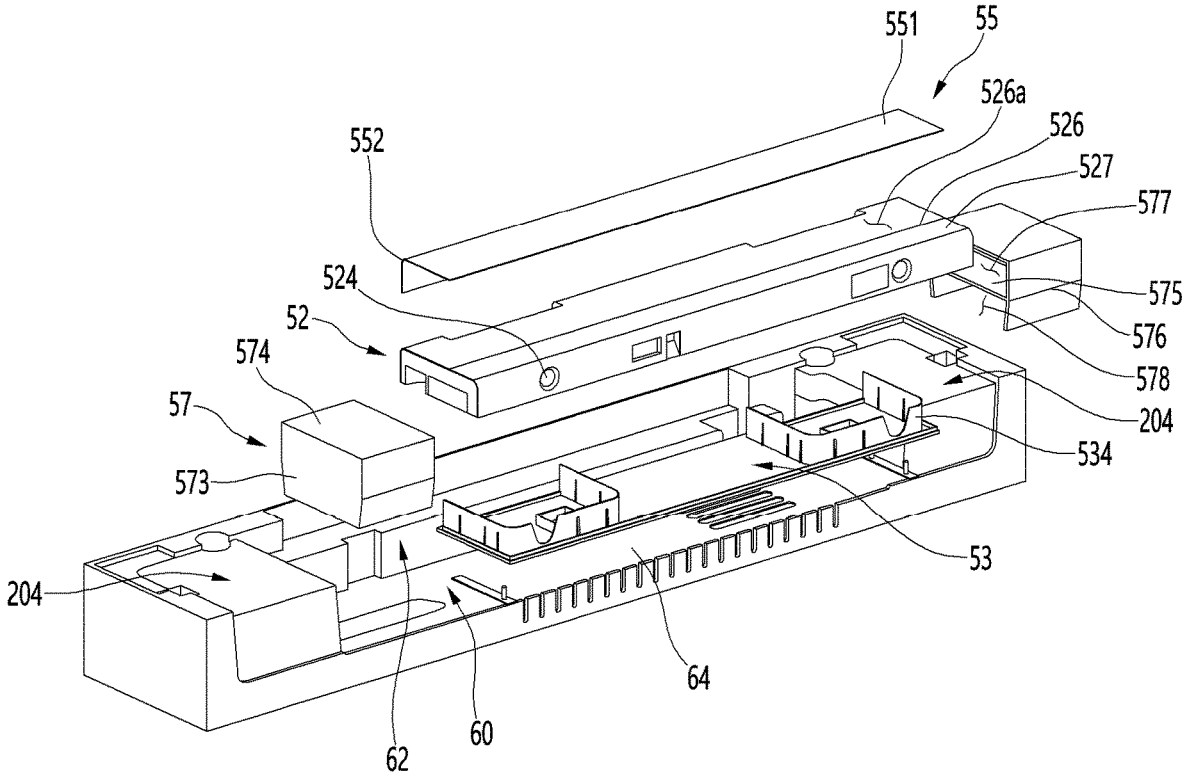
FIG. 5 is an exploded rear perspective view of the speaker device.

FIG. 3 is a front perspective view of the speaker device according to an embodiment. Also, FIG. 4 is an exploded front perspective view of the speaker device. Also, FIG. 5 is an exploded rear perspective view of the speaker device.

A hinge device 204 provided to open and close the upper storage space 11 by rotation of the upper door 20 is provided on a top surface of the outer case 101. The hinge devices 204 are installed on both sides of the top surface of the outer case, and at least a portion of the hinge devices 204 protrudes to be coupled to the upper door 20. For example, the hinge device 204 includes a first hinge device 204*a* to which the left door is rotatably coupled and a second hinge device 204*b* to which the right door is rotatably coupled.

The first hinge device 204*a* and the second hinge device 204*b* are spaced apart from each other, and the speaker device 50 is provided in a space between the first and second hinge devices 204*b*.

In order that the speaker device 50 is installed in a limited space, a length of the speaker device 50 in the left and right direction may be less than or equal to a length between the first hinge device 204*a* and the second hinge device 204*b*.

The length of the speaker device 50 in a front and rear direction may correspond to or be less than the length of each of the first and second hinge devices 204*b* in the front and rear direction.

In addition, the height of the speaker device 50 may be higher than or equal to the height of the hinge device 204.

The speaker device 50 according to an embodiment includes a case 51 providing a space in which components for a sound output, such as the sound output portion 54, are accommodated.

The case 51 may include a first case 52 and a second case 53. The first case 52 and the second case 53 may be coupled to each other. The first case 52 and the second case 53 may be coupled to provide a space, in which components of the speaker device 50 are accommodated.

The first case 52 may form at least a portion of a top surface of the case 51. A bottom surface of the first case 52 may be opened. The opened bottom surface may be shielded by the second case 53.

The second case 53 may be disposed below the first case 52 to define at least a portion of the bottom surface of the case 51.

The front surface of the first case 52 is provided with a sound output hole 521 opened so that a sound source output from the sound output portion 54 is transmitted to the outside of the case 51.

The sound output hole 521 may be provided at a position corresponding to a position at which the sound output portion 54 is installed. For example, the sound output portion 54 may be disposed at both left and right sides of the front surface of the speaker device 50. In addition, the sound output hole 521 may be provided to be opened at a position corresponding to the sound output portion 54 at both the left and right sides of the front surface of the first case 52.

The sound output hole 521 may be recessed backward from the front surface of the first case 52. This is because a space is provided between a front surface portion of the cover 55 to be described later and the sound output hole 521. If there is a gap between the cover 55 and the sound output hole 521, quality of the sound source may be further improved.

The sound output hole 521 may be inclined in a direction away from a front surface portion 52*a* as it goes upward from a bottom surface of the first case 52. In other words, the sound output hole 521 may include an inclined portion 521*a* defined to be inclined backward from a lower end to an upper end thereof.

The sound output hole 521 may be inclined so that the sound source of the sound output portion 54 is output toward a front side of the refrigerator. That is, the sound source of the sound output portion 54 may be output to a front side of the door 20 without interfering with the case 51 or the hinge cover 60. Therefore, there is an advantage of providing improved sound quality to the user.

An insertion portion 522 into which the coupling portion 541 disposed on the sound output portion 54 is inserted may be defined in a rear surface of the sound output hole 521. The insertion portion 522 may extend backward from both the left and right sides of the sound output hole 521. A portion of the insertion portion 522 may be opened so that the coupling portion 541 of the sound output portion 54 is inserted into and fixed to the inside of the insertion portion 522.

An exposed portion 523 may be disposed on the front surface of the first case 52, which is partially opened to expose an input/output portion 56.

The exposed portion 523 may be disposed at a center of the front surface of the first case 52. The exposed portion 523 may be disposed between the sound output holes 521.

An air inlet/outlet hole 524 through which air is introduced and discharged may be defined in a rear surface of the first case 52. The air inlet/outlet hole 524 serves as an air flow path connecting a resonant chamber 53*a* to the outside of the speaker device 50.

The second case 53 defines the bottom surface of the speaker device 50. The second case 53 has an area 531 on which the sound output portion 54 is installed.

The installation area 531 may be defined by being recessed downward. That is, the installation area 531 may have a height less than that of other portions of the bottom surface of the second case 53 excluding the installation area 531.

The sound output portion 54 includes at least a portion of a high-pitched sound output portion (tweeter), a midrange sound output portion (midrange), and a low-pitched sound output portion (woofer). For example, the sound output portion 54 may include a low-pitched sound output portion 542 and a high-pitched sound output portion 543. The sound output portion 54 may be installed to be inclined on the installation area 531.

For example, the sound output portion 54 may be installed at an angle of about 15 degrees from the bottom surface. In this case, even if the speaker device is disposed on the top surface of the refrigerator, the sound source of the sound output portion 54 may be output upward. Thus, it may be transmitted to the user without interference by a cabinet or door adjacent to the refrigerator, and thus, there is an advantage in that rich sound is transmitted.

Each sound output portion 54 may include a coupling portion 541 protruding from one side so as to be inserted into the insertion portion 522. The coupling portion 541 may be inserted into the insertion portion 522 so that the sound output portion 54 is mounted on the front surface of the first case 52.

At least one auxiliary coupling portion 533 may be provided within the installation area 531. The auxiliary coupling portion 533 may be fixed to the first case 52 by a coupling member such as a screw. The first and second cases 53 may be more firmly coupled by the auxiliary coupling portion 533.

The second case 53 may include a protrusion 534 disposed to protrude upward from the bottom surface and surround the sound output portion 54.

The protrusion 534 may provide a resonant space so that the sound source output from the sound output portion 54 properly resonates. The space provided by the protrusion 534 may also be referred to as the resonant chamber 53*a*.

The resonant chamber 53*a* may be provided at each of both left and right sides of the bottom surface of the second case 53.

The bottom surface of the second case 53 may be divided into an area defined as a resonant chamber and an area other than the resonant chamber by the protrusion 534.

A portion of the protrusion 534 facing the rear surface of the speaker device 50 may be cut to provide an entrance 534*a* through which air is introduced and discharged. The entrance 534*a* may be provided at a height less than that of each of other portions of the protrusion 534. The entrance 534*a* corresponds to an air flow path connecting the resonant chamber 53*a* to the outside of the speaker device 50.

A reinforcing portion 535 may be disposed on a bottom surface inside the area of the resonant chamber 53*a*. The reinforcing portion 535 protrudes from the bottom surface of the second case 53 toward the first case 52. The reinforcing portion 535 may be provided in a grid pattern.

An impact or vibration due to opening and closing of the upper door 20 may be transmitted to the top surface of the refrigerator in which the speaker device 50 is installed. Alternatively, the top surface of the refrigerator may transmit the vibrations generated from a refrigerating cycle device. The reinforcing portion 535 may have strength capable of withstanding the impact or vibration to prevent the speaker device 50 from being damaged and deteriorated in performance.

A mounting portion 58 may be provided below the second case 53. The mounting portion 58 may be provided in a pair on both left and right sides of the second case 53.

The mounting portion 58 is disposed between the hinge cover 60 and the speaker device 50. The mounting portion 58 may be provided with a through-hole 581 through which a screw passes so that the second case 53 is coupled thereto. A screw passing through the through-hole 581 may be coupled to the second case 53.

The mounting portion 58 may extend to be elongated in the front and rear direction of the second case 53. The mounting portion 58 may be disposed adjacent to the installation space in which the sound output portion 54 is mounted.

A space for accommodating electronic components may be provided in the space between the left and right resonant chambers 53*a* inside the case 51. In addition to the input/output portion 56, a printed circuit board for operating the speaker device 50 may be installed. In addition, this may also be called a controller.

A wireless communication module may also be installed inside the case 51. The wireless communication module enables wireless connection between the external device 70 and the speaker device 50.

The speaker device 50 may further include a cover 55. The cover 55 may be mounted on a top surface of the first case 52.

An area 526*a* on which the cover 55 is mounted may be provided on the top surface of the first case 52. For example, the area 526*a* on which the cover 55 is mounted may be provided with a stepped portion 526 with respect to other areas of the top surface 527. Due to the stepped portion 526, even when the cover 55 is mounted on the top surface of the first case 52, an overall height of the speaker device 50 may be maintained in parallel.

The cover 55 has a cover top surface portion 551 mounted to be in contact with the top surface of the first case 52 and a cover front surface portion 552 bent downward from the cover top surface portion 551 so as to be in contact with at least a portion of the front surface of the first case 52.

In the cover front surface portion 552, a grill portion 553 may be disposed at a position corresponding to the sound output hole 521. The grill portion 553 may cover the sound output hole 521 at the front side. In this case, a sense of design unity of the refrigerator may be further improved.

The speaker device 50 includes a position fixing portion 57 that prevents the case 51 from moving while the case 51 is mounted on the hinge cover 60.

The position fixing portion 57 may be provided in a pair on both sides of the case 51. That is, the position fixing portion 57 includes a first position fixing portion 57*a* provided on one end of the case 51 and a second position fixing portion 57*b* provided on the other end of the case 51.

The position fixing portion 57 may be provided in a rectangular parallelepiped shape with one surface opened. The position fixing portion 57 may include a front surface portion 571 providing a portion of the front surface of the speaker device 50. An opening 572 is defined in a surface facing the first case 52 based on the front surface portion 571.

The position fixing portion 57 may have a side surface portion 573 defining one surface of the speaker device 50. The side surface portion 573 may be in contact with one surface of the hinge device 204. The side surface portion 573 may have a size corresponding to one surface of the hinge device 204.

The position fixing portion 57 may connect the side surface portion 573 to the opening 572 to provide a top surface portion 574 defining at least a portion of the top surface of the speaker device 50. The top surface portion 574 may be provided as the same plane as the cover 55. In this case, the top surface portion 574 may be disposed higher than the top surface of the hinge device 204.

The position fixing portion 57 has an opening 572 defined therein. The opening 572 may be defined in a surface facing the case 51.

The opening 572 may be defined to correspond to or be greater than the length of the side surface of the case 51 in the front and rear direction. The opening 572 may be defined to correspond to or be less than the length of the hinge cover 60 in the front and rear direction.

At least a portion of the case 51 may be inserted into the opening 572. In a state in which the case 51 is inserted into and fixed to the opening 572, the speaker device 50 may be mounted on the hinge cover 60.

A seating portion 575 may be provided inside the position fixing portion 57 so that the speaker device 50 is seated thereon. The seating portion 575 may be disposed to extend from the front surface portion 571 of the position fixing portion 57 to the rear surface portion 576. The seating portion 575 may connect the front surface portion 571 to the rear surface portion 576.

The seating portion 575 is disposed to be spaced upward from the bottom surface of the hinge cover 60. An inner space of the position fixing portion 57 may be partitioned into an upper space 577 and a lower space 578 by the seating portion 575.

A portion of the case 51 in which the speaker device 50, i.e., the sound output portion 54, etc., is mounted may be inserted into the upper space 577. That is, the speaker device 50 may be seated on the top surface of the seating portion 575. In the state in which the speaker device 50 inserted into the upper space 577, the speaker device 50 may be mounted on the hinge cover 60.

A length of the upper space 577 in the vertical direction may be greater than or correspond to the length of the case 51 in the vertical direction. Thus, in the state in which the case 51 is inserted into the upper space 577, the case 51 may be prevented from moving in the vertical direction.

The length through which the case 51 is inserted into the upper space 577 may be less than a length from a side end of the case 51 to the sound output hole 521. That is, the sound output hole 521 may be prevented from being inserted into the upper space 577 in terms of improvement of the sound source quality.

A length of both left and right sides of the position fixing portion 57 may be greater than a maximum insertion length of the case 51, i.e., a length from one side end of the case 51 to the sound output hole 521. In this case, even if the length of the case 51 in the left and right direction varies, there is an advantage of being fixed to the position fixing portion 57.

At least a portion of the speaker device 50 may be inserted into the upper space 577 so that the speaker device 50 is spaced a set interval upward from the bottom surface of the hinge cover 60. That is, when the speaker device 50 is seated on the hinge cover 60, both side ends of the speaker device 50 may be placed in the state of being spaced apart from the hinge cover 60.

The lower space 578 provides a space in which the hinge cover 60 and the speaker device 50 are spaced upward from each other.

As the speaker device 50 is inserted into the upper space 577 of the position fixing portion 57, the upper portion of the speaker device 50 may be disposed higher than the upper end of the door 20. Due to this structure, the sound source passing through the sound output hole 521 may be prevented from being deteriorated in quality due to the interference with the door 20.

A height of the lower space 578 may be provided to a height corresponding to a height of the upper space 577, but is not limited thereto.

A position stepped portion 579 may be disposed on the front surface portion 571 of the position fixing portion 57. The position stepped portion 579 is disposed at a position corresponding to the seating portion 575. The position stepped portion 579 may guide a position at which the speaker device 50 is inserted. In addition, in the state in which the speaker device 50 is mounted on the hinge cover 60, the position at which the speaker device 50 is disposed may be easily checked.

The position stepped portion 579 may be equally disposed on the rear surface portion 576 of the position fixing portion 57 as necessary.

The lower space 578 may be defined by the front surface portion 571, the rear surface portion 576, and the seating portion 575. The speaker device 50 may be spaced upward from the top surface of the refrigerator by the lower space 578. Thus, an influence of vibration due to the refrigeration cycle device or the like may be minimized. In addition, there is an advantage of minimizing an influence of an impact applied to the refrigerator by opening and closing the door.

The position fixing portion 57 is seated in a space between the hinge cover 60 and the speaker device 50. That is, since the position fixing portion 57 is disposed in the space between the speaker device 50 and the hinge cover 60, the speaker device 50 may be prevented from being separated from the hinge cover 60.

The hinge cover 60 may be provided with a pair of hinge devices 204 at both sides. Each of the hinge devices 204 may be connected to each of the doors 20 so that the doors 20 are rotatably coupled.

The hinge cover 60 may include a front surface portion 61 having at least one surface that is in contact with the door 20, a side surface portion 63 bent to extend backward from the front surface portion 61 to define a side surface, and a bottom portion 64 on which the hinge device 204 is seated and which is contact with the top surface of the outer case 101.

The front surface portion 61 of the hinge cover 60 may be partially opened to provide a cover opening 61*a*. A display portion through which the user checks a current state of the refrigerator or a state of the speaker device 50 may be provided between the cover opening 61*a* and the case 51. The user may check the display portion through the cover opening 61*a*.

The front surface portion 61 of the hinge cover may further include a bent portion 62 that is bent backward. The bent portion 62 may be disposed on a portion other than a portion at which the hinge device 204 is disposed.

The bent portion 62 may be spaced apart from the front surface of the case 51. Thus, a set space may be provided between the front surface portion of the case 51 and the front surface portion 61 of the hinge cover 60. That is, the sound output hole 521 and the front surface portion 61 of the hinge cover may be disposed to be spaced apart from each other. Thus, the sound source output from the sound output portion 54 may pass through the sound output hole 521 and be directed to the outside without interfering with the hinge cover 60. Thus, there is an advantage in that the quality of the sound source output from the speaker device 50 is improved.

The speaker device 50 may be mounted behind the front surface portion 61 of the hinge cover. The case 51 may be spaced apart from the hinge device 204 at both the left and right sides. In addition, the position fixing portion 57 may be disposed between the case 51 and the hinge device 204.

Hereinafter, the structure in which the sound output portion 54 is mounted on the case 51 will be described in detail.

Figure 6:
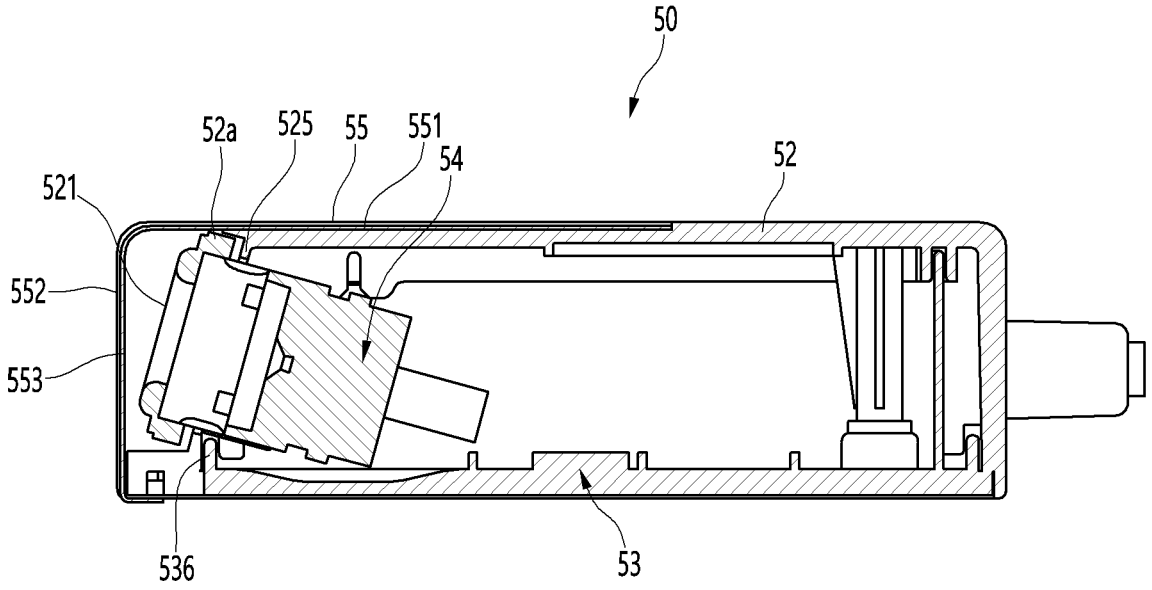
FIG. 6 is a partial cross-sectional view for explaining a state in which the speaker is fixed.

FIG. 6 is a partial cross-sectional view for explaining a state in which the speaker is fixed.

When the speaker device 50 is installed on the top surface of the outer case 101, as the door 20 is disposed in front of the speaker device 50, the sound output from the speaker device 50 may be blocked by the door 20 so as not to be sufficiently transmitted to the user.

In the present disclosure, the sound output portion 54 may be tilted to the case 51 to improve the shape. The sound output portion 54 may be inclined with respect to the top surface of the outer case 101. In other words, the sound output portion 54 may be inclined with respect to the bottom surface of the second case 53.

As described above, when the sound output portion 54 is installed at an angle, a phenomenon in which the sound is blocked by the door 20 may be improved.

A first coupling portion 525 extending downward to fix the sound output portion 54 may be provided on the top surface of the first case 52. The first coupling portion 525 may be in contact with the top surface of the sound output portion 54 to fix the sound output portion 54.

A second coupling portion 536 extending upward to fix the sound output portion 54 may be provided on the bottom surface of the second case 53. The second coupling portion 536 may be in contact with at least one surface of the sound output portion 54. In this case, the sound output portion 54 may be inclined upward from the rear side to the front side.

Figure 7:
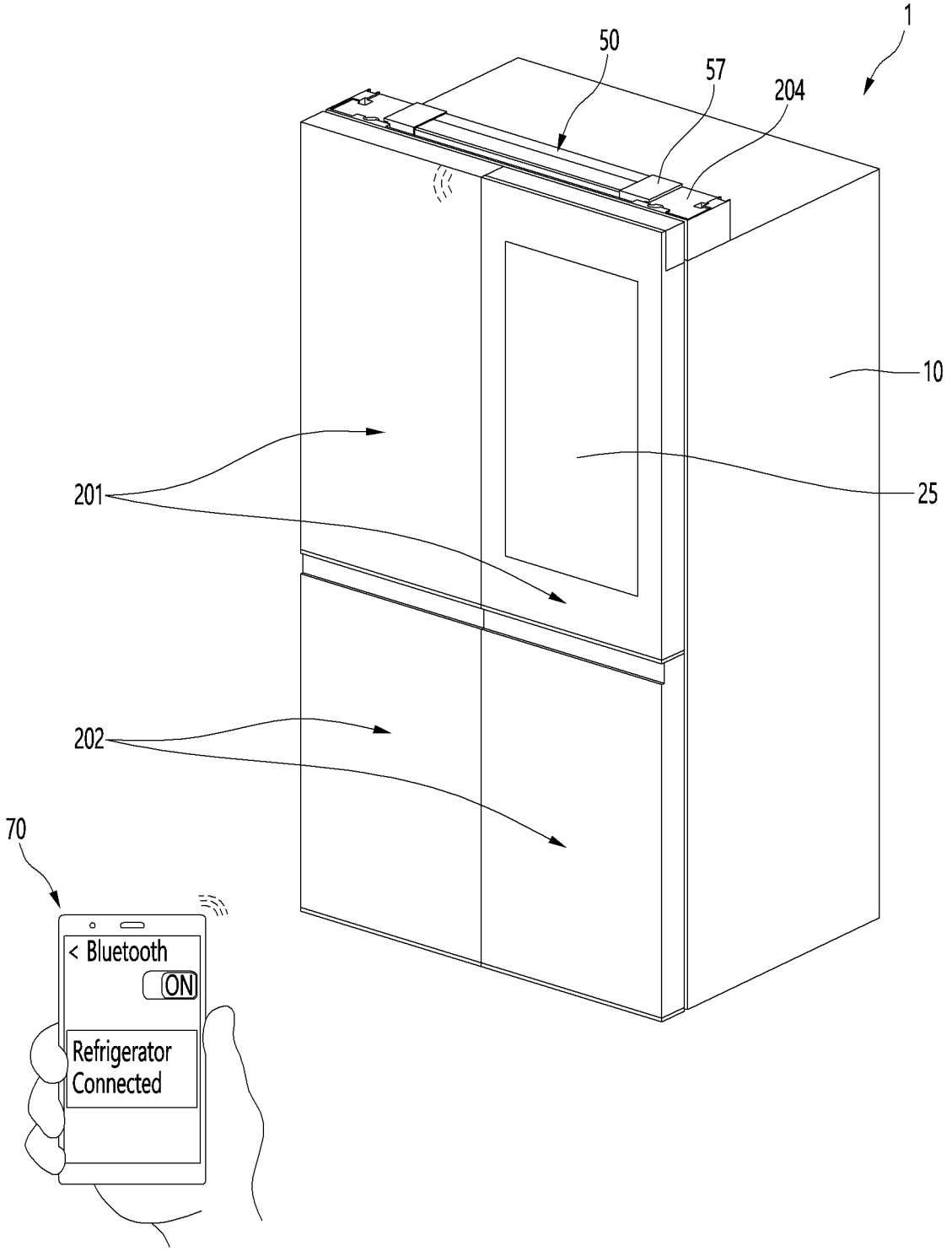
FIG. 7 is a conceptual view for explaining a state in which the speaker is wirelessly connected to the speaker provided in the refrigerator.
Figure 8:
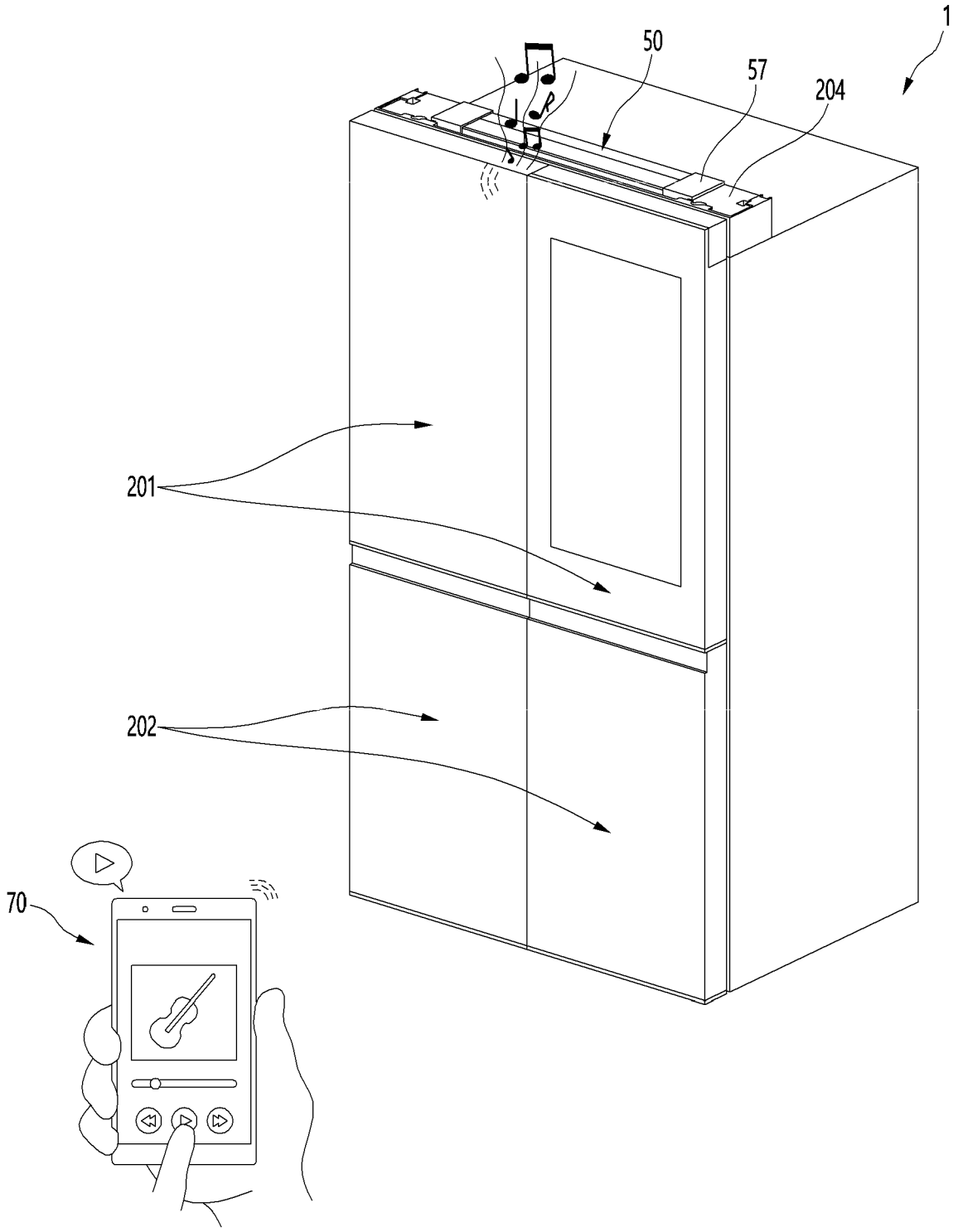
FIG. 8 is a conceptual view for explaining a control process of outputting sound from the speaker provided in the refrigerator by using a wirelessly connected external device.

FIG. 7 is a conceptual view for explaining a state in which the speaker is wirelessly connected to the speaker provided in the refrigerator. Also, FIG. 8 is a conceptual view for explaining a control process of outputting sound from the speaker provided in the refrigerator by using a wirelessly connected external device.

In one embodiment, the user may control the sound output portion 54 by directly manipulating the speaker device 50. However, in this case, accessibility is not high because the speaker device 50 is disposed on the top surface of the refrigerator. Thus, it is more efficient to control the speaker device 50 using the external device 70. Here, it is natural that the external device 70 has also to be a communication device capable of being wirelessly connected to the wireless communication module of the speaker device 50. Examples of the communication devices include smartphones, tablets, laptops, and the like.

For example, as illustrated in FIG. 7, a process of giving authority to control the speaker device 50 to the external device 70 by wirelessly connecting the external device 70 to the speaker device 50 is required. When the external device 70 establishes the wireless connection with the speaker device 50, the authority capable of controlling the speaker device 50 may be given to the external device 70. Here, the wireless connection process between the speaker device 50 and the external device 70 may be displayed on the input/output portion 56 so that the user visually recognizes the wireless connection.

After the authority capable of controlling the speaker device 50 is given to the external device 70, the speaker device 50 may be controlled using the external device 70.

For example, as illustrated in FIG. 8, when a control command for outputting sound is input using the external device 70, the control command may be transmitted to the speaker device 50 through the wireless communication, and the sound may be output from the speaker device 50.

In a home appliance including a cabinet 10 configured to define a storage space with a front surface opened and a door configured to open and close the storage space, a speaker device 50 configured to communicate with an external device 70 and including a sound output portion 54 configured to output sound may be disposed on a top surface of the cabinet 10, and the sound output portion 54 may be disposed to be inclined with respect to the top surface of the cabinet 10.

The speaker device 50 may include a case 51 configured to provide a space in which the sound output portion 54 is accommodated, the case 51 may include an opened sound output hole at a position corresponding to a position at which the sound output portion 54 is installed, and the sound output hole 521 may be recessed backward from a front surface of the case 51.

The sound output portion 54 may be disposed to be inclined from an upper end to a lower end so as to be away from a front surface of the case 51.

The sound output hole 521 may be defined to be inclined from an upper end to a lower end so as to be away from the front surface of the case 51.

A hinge device 204 on which the door is rotatably provided may be disposed at each of both sides of the top surface of the cabinet 10, the speaker device 50 may be disposed in a space between the hinge devices 204 so as to be spaced apart from the hinge devices 204, and a position fixing portion 57 may be disposed in a space in which the speaker device 50 and the hinge device 204 are spaced apart from each other.

In the position fixing portion 57, an opening 572 may be defined in a surface facing the speaker device 50, at least a portion of the speaker device 50 may be inserted into the opening 572, and one surface of the position fixing portion 57 may be disposed to be in contact with one surface of the hinge device 204.

The position fixing portion 57 may include a seating portion 575 provided by connecting a front surface portion to a rear part so that at least a portion of the speaker device 50 is seated thereon.

The seating portion 575 may divide the opening 572 into an upper space and a lower space, and at least a portion of the speaker device 50 may be seated in the upper space.

The speaker device 50 may be disposed to be spaced upward from the top surface of the cabinet 10 in the state of being inserted into the position fixing portion 57.

The case 51 may include a first case 52 configured to define at least a portion of a top surface of the case 51 and be provided by coupling a second case 53 disposed below the first case 52 to define at least a portion of a bottom surface of the case 51.

The sound output hole may be defined in a front surface of the first case 52.

The second case 53 may include a protrusion disposed to protrude upward from the bottom surface and surround the sound output portion 54.

The first case 52 may include a first coupling portion 525 protruding downward from the top surface to fix the sound output portion 54, and the second case 53 may include a second coupling portion 536 extending upward from the bottom surface to fix the sound output portion 54.

A hinge cover 60 may be disposed on the top surface of the cabinet 10, the hinge device 204 may be disposed at both sides of the bottom surface of the hinge cover 60, the speaker device 50 may be disposed between the hinge devices 204, a position fixing portion 57 may be disposed between the hinge device 204 and the speaker device 50, and the position fixing portion 57 may be in contact with one surface of the hinge device 204 and one surface of the speaker device 50.

The front surface portion 61 of the hinge cover 60 may include a bent portion 62 bent backward, and the bent portion 62 may be disposed to be spaced apart from the front surface of the speaker device 50 so that the sound output hole 521 and the front surface portion of the hinge cover 60 are spaced apart from each other.

In an embodiment, the refrigerator 1 provided with the speaker devices 50 and 50 has been described as an example, but is not limited thereto.

The speaker device 50 may be applied to other home appliances in addition to the refrigerator. The home appliance may include a cabinet 10 defining a storage space and a door opening and closing a front surface of the cabinet 10. For example, the home appliance may be any one of a refrigerator, an air conditioner, a dishwasher, a clothing manager, a washing machine, or a cooking appliance.

For example, in a home appliance according to an embodiment, which includes a cabinet 10 configured to define a storage space with a front surface opened and a door configured to open and close the storage space, a speaker device 50 configured to communicate with an external device 70 and including a sound output portion 54 configured to output sound may be disposed on a top surface of the cabinet 10, and the sound output portion 54 may be disposed to be inclined with respect to the top surface of the cabinet 10.

According to another embodiment, the home appliance may further include a microphone module 33 together with a speaker device 50.

In another embodiment, a micro module capable of improving voice recognition performance may be provided.

The micro module may effectively recognize voices and control an operation of the refrigerator. The microphone module capable of effectively recognizing a user's voice without interference with a sound output from a speaker may be provided.

Hereinafter, other embodiments will be described in detail.

Figure 9:
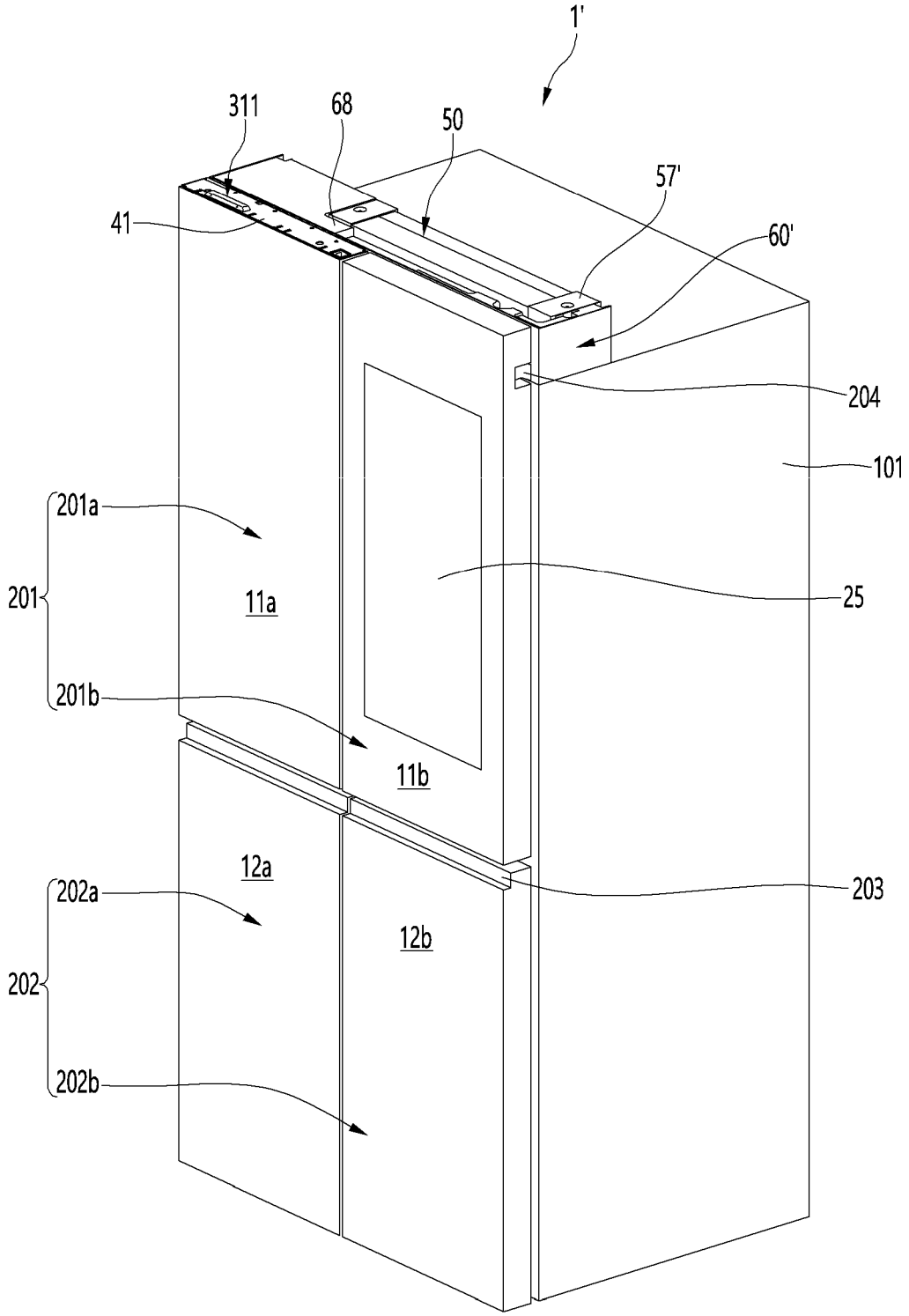
FIG. 9 is a front perspective view of the refrigerator according to an embodiment.
Figure 10:
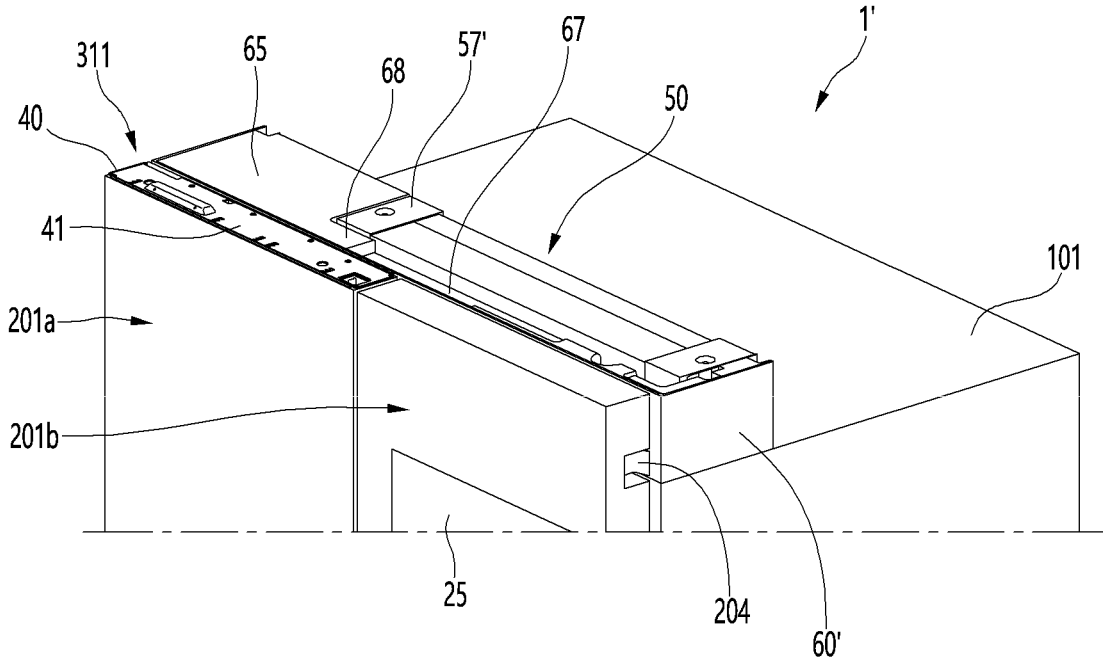
FIG. 10 is a top perspective view of the refrigerator.

FIG. 9 is a front perspective view of the refrigerator according to an embodiment. Also, FIG. 10 is a top perspective view of the refrigerator.

In another embodiment, the description of the refrigerator according to the foregoing embodiment will be cited, and other portions will be described in detail.

In another embodiment, the speaker device 50 may be disposed at a position biased to one side with respect to a left and right direction on a top surface of the refrigerator. In other words, a center of the speaker device 50 may be disposed at a position biased to one side from a center of the top surface of the refrigerator.

For example, the speaker device 50 may be disposed closer to a right refrigerating compartment door 201*b* than a left refrigerating compartment door 201*a*. That is, the speaker device 50 may be disposed behind the right refrigerating compartment door 201*b*. In other words, the speaker device 50 may be disposed biased toward a direction in which a hinge device is provided based on left and right centers on the top surface of the refrigerator.

A microphone mounting portion 311 on which a microphone module 33 is mounted may be disposed in a state of being spaced as much as possible from the position at which the speaker device 50 is disposed. For example, the microphone module 33 may be disposed on a top surface of the left refrigerating compartment door 201*a*. In addition, the microphone module 33 may be disposed in a state that is close to one side, at which a hinge device is disposed, among both left and right sides of the top surface of the left refrigerating compartment door 201*a*.

That is, in an embodiment, the speaker device 50 and the microphone module 33 may not be disposed on the same left and right lines. In addition, the speaker device 50 may be disposed biased to one side with respect to the center of the refrigerator 1, and the microphone module 33 may be disposed biased to the other side with respect to the center of the refrigerator 1.

In this case, the speaker device 50 and the microphone module 33 may be spaced apart from each other as much as possible to prevent a user's voice from being input from the speaker device 50 to the microphone module 33.

The microphone module 33 for receiving the user's voice may be provided on a top surface of the door 20. The microphone module 33 may be mounted on the microphone mounting portion 311 protruding from the top surface of the left refrigerating compartment door 201*a*, i.e., the upper left door 201*a*. The microphone module 33 may be provided inside the microphone mounting portion 311. When the microphone module 33 is disposed on one end of the door 20, the user may more effectively recognize when speaking at the center of the refrigerator 1.

For example, the microphone module 33 and the microphone mounting portion 311 may be disposed in the left refrigerating compartment door 201*a* of the left refrigerating compartment door 201*a* and the right refrigerating compartment door 201*b*. The microphone module may be disposed at a position that is tilted to the left or at a left end of the top surface of the left refrigerating compartment door 201*a*.

In this case, a voice recognition rate of the microphone module 33 may be further improved. In detail, since the user opens and closes the right refrigerating compartment door with the right hand, the user may stand closer to the left refrigerating compartment door 201*a* than to the right refrigerating compartment door. Therefore, when the microphone module 33 is provided in the left refrigerating compartment door 201*a*, the user's voice may be recognized more effectively.

In addition, the speaker device 50 may be disposed closer to the right refrigerating compartment door 201*b* of the left refrigerating compartment door 201*a* and the right refrigerating compartment door 201*b*. In this case, the speaker device 50 and the microphone module 33 may be spaced apart from each other as much as possible.

The microphone mounting portion 311 may be virtually invisible when viewed from a front side due to its shape. In general, since a height of the refrigerator is greater than a user's height, the microphone mounting portion 311 may be invisible to user's eyes in a normal use environment.

That is, the microphone mounting portion 311 may have a position and structure that secure a high recognition rate while minimizing external exposure.

Hereinafter, the structures of the microphone mounting portion 311 and the microphone module 33 will be described in more detail.

In one embodiment, the microphone module 33 may be provided on the left refrigerating compartment door 201*a* as an example, but the embodiment may be applied to all types of refrigerators in which the cap decoration is disposed on the top surface of the door.

Hereinafter, in describing the microphone mounting portion 311 and the microphone module 33, the left refrigerating compartment door 201*a* provided with the microphone mounting portion 311 will be referred to as the door 20.

Figure 11:
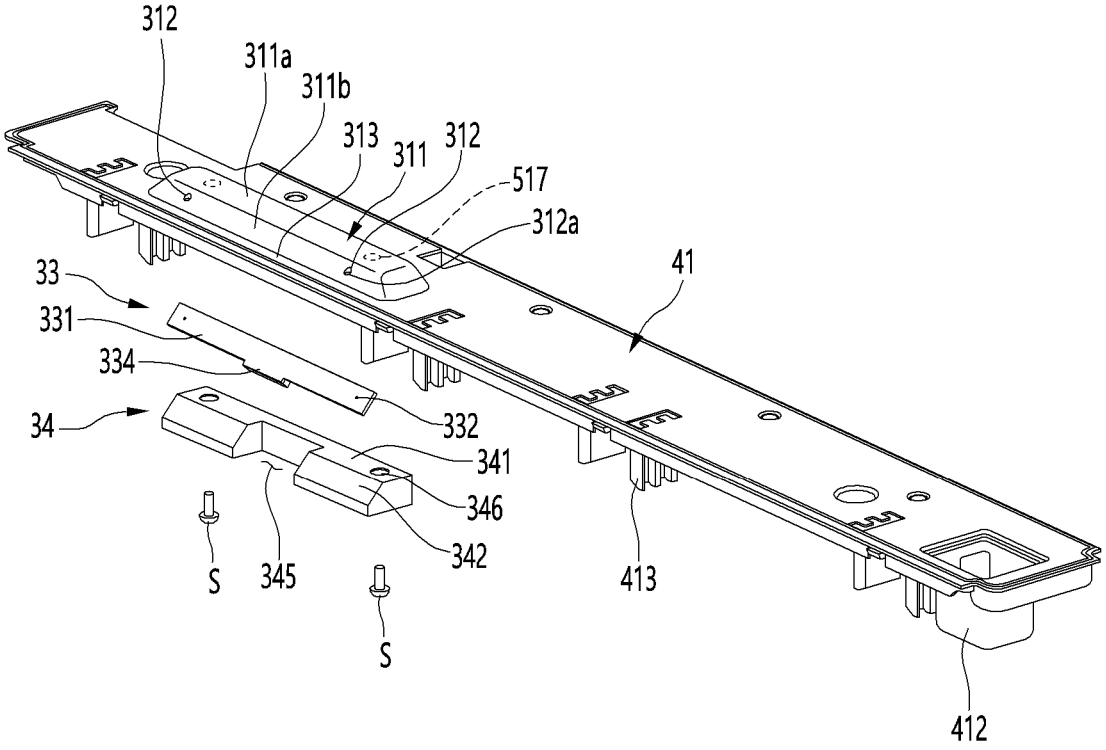
FIG. 11 is an exploded front perspective view of a microphone module according to an embodiment.

FIG. 11 is an exploded front perspective view of the microphone module according to an embodiment.

An outer appearance of the door 20 may be defined by coupling an outer plate defining an outer appearance including a front surface and a door liner defining a rear surface. An insulating material may be filled in a space between the outer plate and the door liner. In addition, a cap decoration 40 may be provided on the top surface of the door 20.

The microphone mounting portion 311 to which the microphone module 33 accommodating the user's voice is mounted may protrude from the top surface of the door 20. The microphone module 33 may be accommodated in an inner space of the cap decoration 40. In addition, the microphone module 33 may be shielded by the door cover 41 of the cap decoration 40. The microphone mounting portion 311 may be integrated with the door cover 41.

The microphone mounting portion 311 may be disposed at one side end of both side ends of the door 20. In detail, the microphone mounting portion 311 may be provided on the top surface of the door 20 and may be disposed adjacent to the hinge devices 204 and 205 on both sides of the top surface of the door.

In addition, the microphone mounting portion 311 may be disposed closer to the front end of the front end and the rear end on the top surface of the door 20. This arrangement has an advantage of improving the user's voice recognition rate.

The door cover 41 may extend to be elongated along the top surface of the door 20. The door cover 41 may shield the top surface of the door 20 in the state in which the microphone module 33 is mounted on the microphone mounting portion 311.

The microphone mounting portion 311 may be disposed on one end of the door cover 41. A wire connection portion 412 having an opened top surface and extending downward may be disposed on the other end of the door cover 41. A wire may be connected to the microphone module 33 or the speaker device 50 through the wire connection portion 412.

A coupling portion 413 extending downward may be further disposed on the rear surface of the door cover 41. The coupling portion 413 may be provided in plurality along the direction in which the rear surface of the door cover 41 extends. The coupling portion 413 may be coupled to the cap decoration 40 to shield the top surface of the door.

The microphone mounting portion 311 may include a protrusion 311*a* protruding upward from the door cover 41 and an inclined portion 311*b* disposed on a front end of the protrusion 311*a*. A microphone recessed portion 313 may be further disposed on an end of the inclined portion 311*b*.

The protrusion 311*a* may be a most protruding portion of the microphone mounting portion 311 and may protrude parallel to the top surface of the door cover 41. A microphone mounting boss 317 may be disposed below the protrusion 311*a*. A pair of the microphone mounting bosses 317 may be provided on both left and right sides. The microphone mounting boss 317 may be inserted into a supporter through-hole 346 defined in a microphone supporter 34. In addition, a screw S coupled to the supporter through-hole 346 may be coupled so that the microphone supporter 34 is fixedly mounted on a bottom surface of the protrusion 311*a*.

A protruding height of the protrusion 311*a* may be defined at a height at which the microphone hole 312 is defined in the inclined portion 311*b*, and the microphone mounting portion 311 may be disposed at a height at which the microphone mounting portion 311 is not seen as much as possible when viewed from the front side.

The inclined portion 311*b* may be disposed on a front end of the microphone mounting portion 311 and may be inclined downward as it extends forward.

The inclined portion 311*b* may have a predetermined width and may have a corresponding size and shape so that the microphone module 33 is closely attached to a rear surface of the inclined portion 311*b*.

The microphone hole 312 is defined in the inclined portion 311*b*. The microphone hole 312 may be disposed at a position corresponding to a center of a microphone element 332. For example, a pair of microphone holes 312 may be provided at both left and right sides. That is, a pair of microphone elements 332 corresponding to the microphone hole 312 may also be provided, and a voice passing through the pair of microphone holes 312 may be inputted.

A hole guide 312*a* may be defined around the microphone hole 312. The hole guide 312*a* may protrude along a circumference of the microphone hole 312. The hole guide 312*a* may be disposed so that a protruding height gradually decreases from the upper side to the lower side. Thus, the hole guide 312*a* may prevent the dust or foreign materials from being directly introduced into the microphone hole 312 when dust or foreign materials falls from the upper side.

A recessed portion 313 may be further disposed in front of the inclined portion 311*b*. The recessed portion 313 may be recessed downward from the end of the inclined portion 311*b* so that dust or foreign materials falling from the upper side are collected. Therefore, even if the dust or foreign materials falls from the upper side and are accumulated on the top surface of the door cover 41, the microphone hole 312 is not easily covered.

The microphone module 33 may be disposed to be close contact with the rear surface of the microphone mounting portion 311. The microphone module 33 may include a microphone substrate 331 and a microphone element 332.

In detail, the microphone element 332 may be mounted on the microphone substrate 331 at regular intervals and may be supported by the microphone substrate 331.

The microphone substrate 331 may be provided in a plate shape to be elongated in the horizontal direction so as to be mounted on the inclined portion 311*b* of the microphone mounting portion 311.

In this embodiment, a pair of microphone elements 332 disposed at left and right side are described as an example, but is not limited thereto. For example, the microphone element 332 may be provided in plurality.

As the microphone element 332, elements having various structures capable of receiving the user's voice input may be used.

The pair of microphone elements 332 may be disposed on both left and right sides to further improve the recognition rate. In addition, since the microphone elements 332 are disposed at both the left and right sides, a difference in intensity of each sound input to the pair of microphone elements 332 may occur, and thus, a position at which the sound is input may be determined.

A substrate hole 531*a* passing through the microphone substrate 331 may be defined in each of both sides of the microphone substrate 331. The substrate hole may be defined at a position corresponding to the microphone element 332 and have a structure through which the user's voice is transmitted to the microphone element 332.

A microphone connector 334 may be provided at a center of the bottom surface of the microphone substrate 331. The microphone connector 334 may protrude downward and be inserted into the connector hole 345 of the microphone supporter 34.

The microphone supporter 34 may be mounted on the door cover 41 so that the microphone module 33 is tightly fixed to the inclined portion 311*b*.

The top surface of the microphone supporter 34 may include a mounting surface 341 and a support surface 342.

The mounting surface 341 may be a portion for mounting the microphone supporter 34 and may be disposed parallel to the bottom surface of the protrusion 311*a*. A pair of supporter through-holes 346 may be defined in both sides of the mounting surface 341 to pass through the microphone supporter 34 in the vertical direction. A screw S may be coupled below the supporter through-hole 346 to be coupled to the microphone mounting boss 317.

The support surface 342 is disposed on the front end of the mounting surface 341 and has an inclination that gradually decreases toward the front side. The support surface 342 may have a size in which the microphone module 33 is seated. The support surface 342 may have an inclination corresponding to that of the inclined portion 311*b*. The microphone module 33 may be disposed between the inclined portion 311*b* and the support surface 342.

A connector hole 345 may be disposed at a center of the microphone supporter 34. When the microphone module 33 is mounted on the support surface 342, the microphone connector 334 may be exposed downward through the connector hole 345. Therefore, the wire connection is possible in a state in which the microphone module 33 is fixedly mounted on the door cover 41.

The speaker device 50 according to another embodiment may be disposed on the top surface of the cabinet 10.

The speaker device 50 may be spaced apart from the microphone module 33 as much as possible. This is because the voice recognition rate increases when the user intends to control the operation of the refrigerator or the like by using a voice command in the state in which sound is output from the speaker device 50.

The speaker device 50 will be described below.

Figure 12:
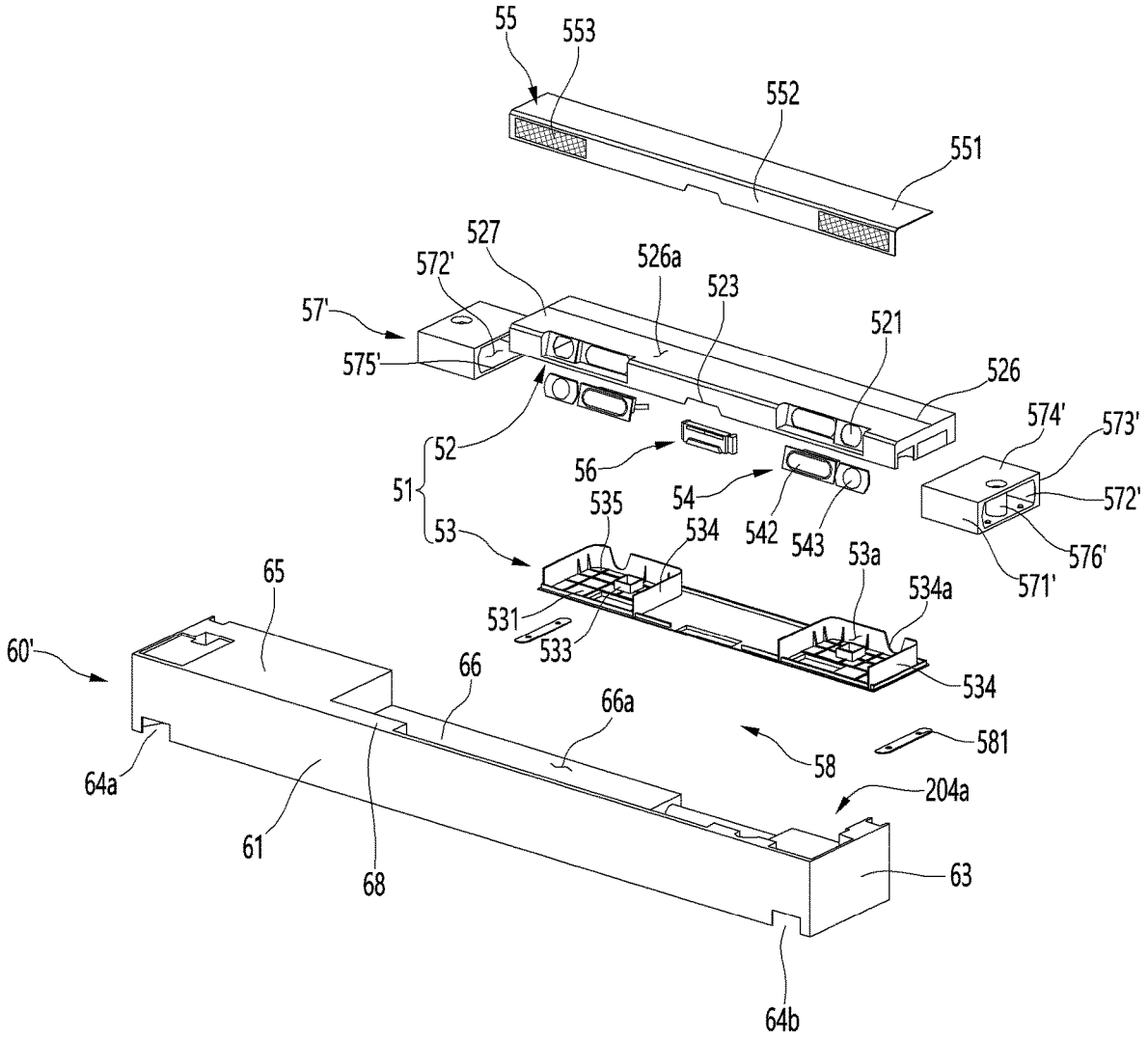
FIG. 12 is an exploded front perspective view of the speaker device.
Figure 13:
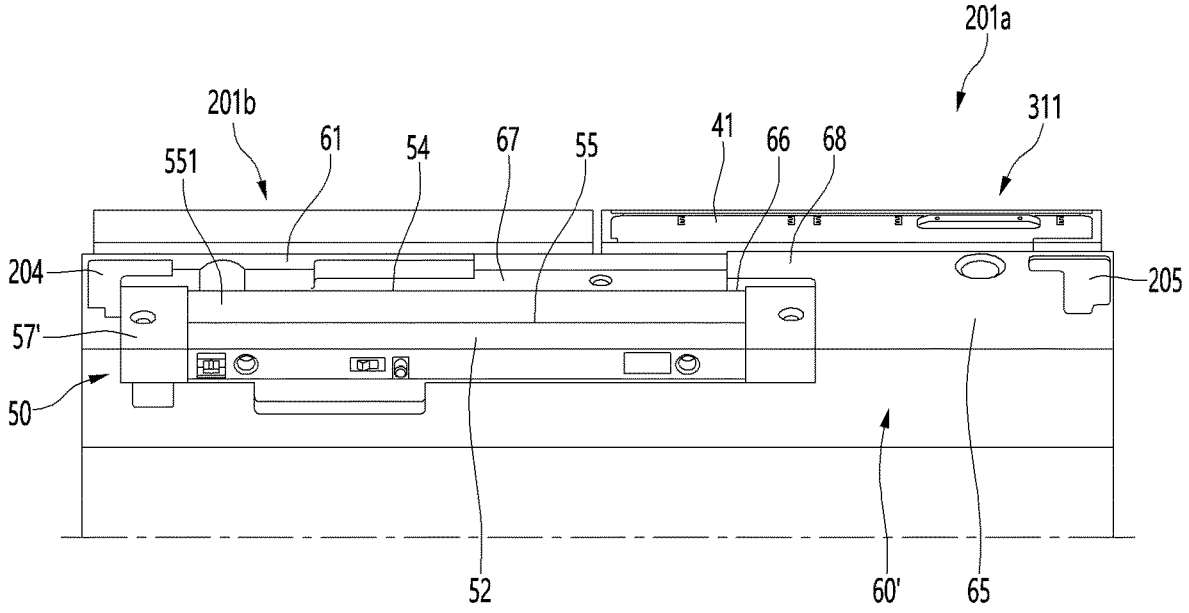
FIG. 13 is a view illustrating a state in which the microphone module and the speaker device are disposed according to an embodiment.

FIG. 12 is an exploded front perspective view of the speaker device. Also, FIG. 13 is a view illustrating a state in which the microphone module and the speaker device are disposed according to an embodiment.

The speaker device 50 may be disposed spaced apart from the microphone module 33 on the top surface of the cabinet 10. In one embodiment, the microphone mounting portion 311 to which the microphone module 33 is mounted may be disposed on the top surface of the left refrigerating compartment door 201*a*. Also, the speaker device 50 may be disposed adjacent to the right refrigerating compartment door 201*b*.

The speaker device 50 according to another embodiment cites the description of the speaker device 50 according to the foregoing embodiment except for other portions to be described later.

The speaker device 50 includes a bracket 57' that fixes the position of the speaker device 50 in a state in which the case 51 is mounted on a hinge cover 60'.

The brackets 57' may be provided in a pair at both sides of the case 51.

At least one surface of the bracket 57' may be opened so that at least a portion of the speaker device 50 is inserted. In detail, the bracket 57' includes a front surface 571', a rear surface 573', and an opening 572' defined by opening both surfaces. The bracket 57' may further include a top surface 574' and a bottom surface 575'.

The opening 572' may be defined to correspond to or be longer than a length of the side surface of the case 51 in the front and rear direction. The opening 572' may be defined to correspond to or be smaller than a length of the hinge cover 60' in the front and rear direction.

At least a portion of the case 51 may be inserted into the opening 572'. In a state in which the case 51 is inserted into and fixed to the opening 572, the speaker device 50 may be mounted on the hinge cover 60'.

A bracket reinforcing portion 576' connecting the top surface 574' to the bottom surface 575' may be further disposed inside the bracket 57'. The bracket reinforcing portion 576' serves to fix both ends of the speaker device 50 in the state where the speaker device 50 is inserted into the bracket 57'. In addition, there is an advantage in that strength of the bracket 57' is further strengthened.

A pair of hinge devices may be provided at both sides of the hinge cover 60', respectively. Each of the hinge devices may be connected to the door 20 so that the door 20 is rotatably coupled.

The hinge cover 60' includes a front surface portion 61 having at least one surface that is in contact with the door 20 and a side surface portion 63 bent to extend backward from the front surface portion 61 to define a side surface.

The front surface portion 61 may include a first mounting portion 64*a* and a second mounting portion 64*b*, which are disposed apart from each other in a left and right horizontal direction. The first mounting portion 64*a* may be disposed close to one side surface portion of the pair of side surface portions 63, and the second mounting portion 64*b* may be disposed close to the other side surface portion of the pair of side surface portions 63. The first mounting portion 64*a* and the second mounting portion 64*b* allow the hinge device to be connected to the door 20 so that the door 20 is rotatably opened and closed.

The hinge cover 60' includes a top surface portion 65 defining a top surface. The top surface portion 65 includes a recessed portion 66 defined by recessing at least a portion thereof downward. The recessed portion 66 may define at least a portion of the bottom surface of the hinge cover 60'.

The recessed portion 66 defines a space in which the speaker device 50 is accommodated. The recessed portion 66 may have a size corresponding to that of the speaker device 50.

The top surface portion 65 may extend from one side surface of the hinge cover 60' in a direction in which the speaker device 50 is disposed.

For example, the top surface portion 65 may be disposed at the rear side of the door 20 provided with the microphone mounting portion 311. In other words, at least a portion of the top surface portion 65 may be disposed behind the microphone mounting portion 311.

The recessed portion 66 may be defined in one end of the top surface portion 65. The speaker device 50 may be disposed on the top surface of the cabinet 10 from the center in the left or right direction. Thus, the recessed portion 66 may also be provided in a state of being biased around the center of the left and right sides of the hinge cover 60'. For example, the recessed portion 66 may be disposed adjacent to the right refrigerating compartment door 201*b* rather than the left refrigerating compartment door 201*a*.

In a state in which the speaker device 50 is mounted on the recessed portion 66, the top surface portion 65 of the hinge cover 60' may be disposed higher than the top surface of the speaker device 50. Thus, the top surface portion 65 of the hinge cover 60' may be disposed at a position corresponding to the top surface of the speaker device 50.

The stepped portion 67 extending in a direction in which the speaker device 50 is seated may be disposed on the front surface portion 61 of the hinge cover 60'. The stepped portion 67 may allow the speaker device 50 to be spaced apart from the front surface portion 61 of the hinge cover 60' in the front and rear direction.

Thus, a set space may be defined between the front surface portion 61 of the hinge cover 60' and the front surface of the speaker device 50. Due to this structure, there is an advantage in that sound output from the speaker device 50 is transmitted to the outside without interfering with the hinge cover 60'.

A height of the stepped portion 67 in the vertical direction may be less than that of the front surface portion 61. In addition, the height of the stepped portion 67 in the vertical direction may be less than an overall height of the speaker device 50 in the vertical direction.

A cover portion 68 may be disposed in front of the speaker device 50. The cover portion 68 serves to prevent sound output from the speaker device 50 from being input to the microphone module 33.

The cover portion 68 may be disposed at a height corresponding to the height of the speaker device 50 in the vertical direction.

The cover portion 68 may be connected to the top surface portion 65 to have the same height as the height of the top surface portion 65 in the vertical direction. The cover portion 68 may be provided to further protrude upward from one side end of the stepped portion 67.

The cover portion 68 may be disposed at a side end adjacent to the microphone module 33 among both ends of the speaker device 50.

For example, in one embodiment, the microphone mounting portion 311 to which the microphone module 33 is mounted is disposed on the top surface of the left refrigerating compartment door 201*a*. In addition, the speaker device 50 may be disposed on the top surface of the cabinet adjacent to the right refrigerating compartment door 201*b*.

In this case, the cover portion 68 may be disposed on a front left side of the speaker device 50.

The cover portion 68 may be integrated with the top surface portion 65 of the hinge cover 60'. The top surface portion 65 may extend in a direction closer to the speaker device 50. When the speaker device 50 is mounted on the hinge cover 60', the cover portion 68 may correspond to or extend longer than the length of the bracket 57' in the left and right direction.

An end of the cover portion 68 may be spaced apart from a side end of the grill portion 553. That is, the cover portion 68 may extend from the top surface portion 65 in a direction in which the speaker device 50 is disposed, but may be provided so as not to cover a front side of the grill portion 553. This is to prevent the entire sound source output through the grill portion 553 from being interfering by the cover portion 68.

The sound source output from the sound output portion 54 transfers sound waves while drawing a parabola. Here, the cover portion 68 may block the sound waves directed to the microphone module 33. Therefore, the sound output from the speaker device 50 may be prevented from being input to the microphone module 33. Furthermore, even if the user speaks a voice while music is being reproduced in the speaker device 50, the microphone module 33 may recognize a user's voice command without interfering with the sound source of the speaker device 50.

The cover portion 68 may be integrated with the top surface portion 65 or may be disposed to be spaced apart from the top surface portion 65.

Figure 14:
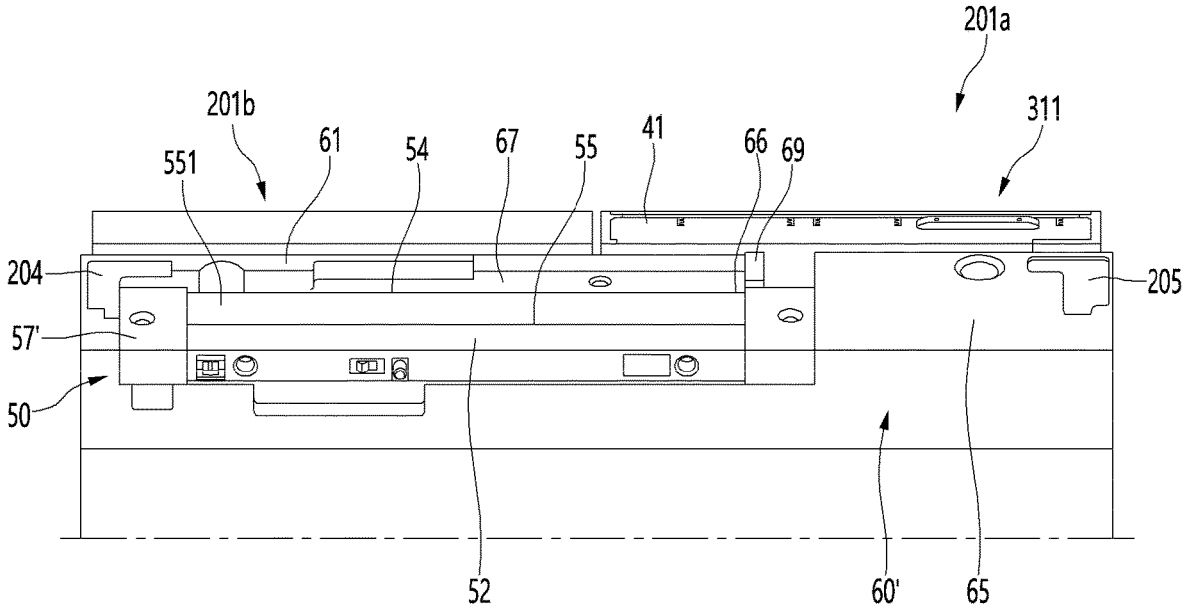
FIG. 14 is a view illustrating a state in which a microphone module and a speaker device are disposed according to another embodiment.

FIG. 14 is a view illustrating a state in which a microphone module and a speaker device are disposed according to further another embodiment.

In another embodiment, a microphone mounting portion 311, a microphone module 33, and a speaker device 50 may have the same structure as those according to the foregoing embodiment except for a difference in shape and arrangement of the cover portion 69.

For example, the microphone mounting portion 311 to which the microphone module 33 is mounted may be provided on a top surface of any one of the left and right doors. In addition, the speaker device 50 may be disposed on a top surface of the cabinet adjacent to a door in which the microphone mounting portion 311 is not provided.

The cover portion 69 according to another embodiment may protrude upward from the hinge cover 60'. In detail, the cover portion 69 may be spaced apart from the top surface portion 65 and disposed in front of one side of the speaker device 50.

The cover portion 69 may be disposed in a space between the rear surface of the door 20, in which the microphone mounting portion 311 is disposed, and the front surface of the speaker device 50. In other words, the cover portion 69 may be provided between the front surface portion 61 of the hinge cover 60' and the front surface of the speaker device 50.

In addition, although the cover portion 69 may be provided singly, a plurality of cover portions 69 may be arranged in a line.

The cover portion 69 may be disposed in front of one side adjacent to the microphone mounting portion 311 among both the sides of the speaker device 50. For example, the microphone mounting portion 311 may be disposed on the top surface of the left refrigerating compartment door 201*a*. Also, the speaker device 50 may be disposed on the rear side of the right refrigerating compartment door 201*b*. Here, the cover portion 68 may be disposed in front of the left side of the speaker device 50.

The cover portion 69 may block a sound source output from the speaker device 50 and transmitted in a direction in which the microphone mounting portion 311 is disposed.

Figure 15:
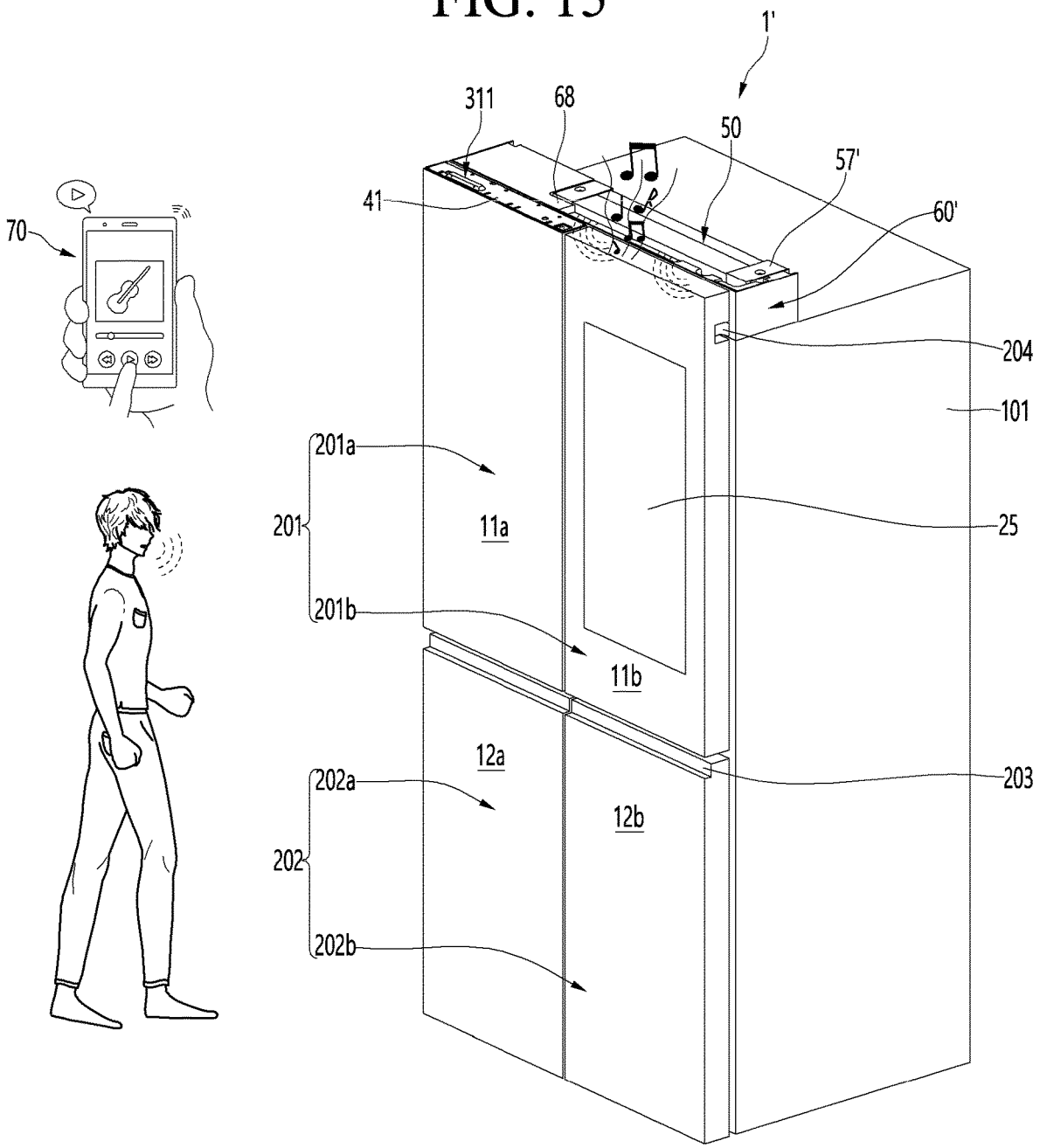
FIG. 15 is a view illustrating a state in which sound is output from the speaker device.

FIG. 15 is a view illustrating a state in which sound is output from the speaker device.

In one embodiment, the speaker device 50 may be controlled by the external device 70 by wirelessly connecting the external device 70 to the speaker device 50.

In one embodiment, when the user speaks a set trigger voice in front of the refrigerator 1, a voice recognition mode is activated by the microphone module 33, and then, the user input a voice command for the operation of the refrigerator 1. When the user orders a command, a voice signal input through the microphone module 33 may be transmitted to the main controller to control a specific operation of the refrigerator.

For example, the user may check an operation state of the refrigerator 1 by turning on or off a display of the refrigerator 1 by the voice command.

Also, the user may turn on/off a door light by the user's voice command. When the door light is turned on and off, a sub door may selectively become transparent and opaque. In the state in which the door light is turned on, a see-through portion of the sub door is visualized so that the inside of the door basket is identified in the state in which the sub door is closed.

In addition, various operation information including changes in operation state or a setting state of the refrigerator 1 may be displayed on a screen through the display or auxiliary display or may be output as audio through the speaker device 50.

In the state in which sound such as music is being reproduced in the speaker device 50, the user may input the voice command to control the setting or operation of the refrigerator. Since the microphone module 33 is disposed close to the front end of the top surface of the door, the user's voice input may be recognized regardless of where the user is disposed in front of the refrigerator.

The sound source output from the speaker device 50 may be blocked from traveling toward the microphone module 33 by the cover portion 68. Therefore, the sound source emitted from the speaker device 50 may not interfere with the microphone module 33. Then, the microphone module 33 may recognize the user's voice command to perform the control or operation accordingly.

Thus, the microphone module 33 may receive the user's voice command without interfering with the sound source output from the speaker device 50 and may perform the control or operation according to the voice command.

As described above, in the refrigerator according to another embodiment, the microphone mounting portion 311, on which the microphone module 33 is mounted, and the speaker device 50 may be spaced apart from each other as much as possible without being disposed on the same line at the left and right sides, and thus, the sound source output from the speaker device may be prevented from being input into the microphone module 33.

In detail, the refrigerator according to another embodiment may include a cabinet 10 defining a storage space, a door 20 opening and closing the storage space, a microphone mounting portion, on which the microphone module 33 is mounted and in which a microphone hole 312 is defined, and a speaker device 50 disposed on a top surface of the cabinet 10 and including a sound output portion 54, and the microphone mounting portion 311 and the speaker device 50 may not be disposed on the same line on left and right sides.

The microphone mounting portion 311 may be disposed at a position at which a center thereof is biased from a center to one side in the left and right direction of the cabinet, and the speaker device 50 may be disposed at a position at which a center thereof is biased from the center to the other side in the left and right direction of the cabinet.

In the door, a left door 201*a* and a right door 201*b* may be disposed in a pair side by side, and the microphone mounting portion 311 may be provided on a top surface of any one of the left door 201*a* and the right door 201*b*. A center of the speaker device 50 may be disposed closer to the door without the microphone mounting portion 311 among the left door 201*a* and the right door 201*b*.

The microphone mounting portions 311 may be disposed close to one side, which is close to the hinge device 204 of both the left and right sides of the door.

The microphone mounting portion 311 may be disposed closer to the front end than the rear end of the door.

The microphone mounting portion 311 may be disposed on the left door 201*a*, and the speaker device 50 may be disposed at a position at which a center thereof is biased to a right side from a center of the cabinet in the left and right direction.

The microphone mounting portion 311 may include a protrusion 311*a* protruding upward from the top surface of the door and an inclined portion 311*b* inclined downward as it extends forward from the front end of the protrusion 311*a*, and the microphone hole 312 may be provided in a pair on the inclined portion 311*b*.

The microphone module 33 may be mounted on a rear surface of the inclined portion 311*b* and may include a microphone substrate 331 and a microphone element 332 mounted to be spaced a predetermined interval from the microphone substrate 331.

A hinge cover 60' may be disposed on the top surface of the cabinet, and the hinge cover 60' may include a front portion, a top surface portion that is bent to extend backward from an upper end of the front surface portion, and a recessed portion 66 defining a space, into which the speaker device 50 is accommodated, by recessing at least a portion of the top surface portion. The recessed portion 66 may be disposed to be biased to one side from a center of the hinge cover 60' in the left and right direction.

In the hinge cover 60', a stepped portion may be disposed between the front surface portion and the recessed portion 66, and the front surface portion of the hinge cover 60' may be spaced apart from the speaker device 50 by the stepped portion.

The hinge cover 60' may include a cover portion disposed in front of one side adjacent to the microphone mounting portion 311 among both sides of the speaker device 50 and disposed at a height corresponding to a vertical height of the top surface portion.

The cover portion may be disposed to extend from one end of the top surface portion in a direction in which the speaker device 50 is disposed.

The hinge cover 60' may include a stepped portion disposed between the front surface portion and the recessed portion 66 so that the front surface portion and the speaker device 50 are spaced apart from each other, and the cover portion may be disposed in the same line as the stepped portion in the left and right directions. In addition, the cover portion may be disposed at a height higher than a vertical height of the stepped portion.

The cover portion may be disposed between a front surface of the speaker device and the door and be spaced apart from the top surface portion so as to be provided in singularity or plurality.

A refrigerator according to an embodiment may include a cabinet defining a storage space, a door opening and closing the storage space, a microphone mounting portion 311 on which a microphone module 33, into which a user's voice command is input, is mounted, and a speaker device 50 including a sound output portion 54 that outputs sound. The door may include a pair of left and right doors 201*a* and 201*b*, which are disposed side by side, and the microphone mounting portion 311 may be provided on a top surface of the left door 201*a*. The speaker device 50 may be disposed on a top surface of the cabinet, and a center of the speaker device 50 may be disposed closer to the right door 201*b* of the left door 201*a* and the right door 201*b*.

The microphone mounting portion 311 may be disposed to be biased toward one side close to the hinge device 204 in the left door 201*a* and may be disposed closer to a front end than a rear end of the left door 201*a*.

The microphone mounting portion 311 may include a protrusion 311*a* protruding upward from the top surface of the door and an inclined portion 311*b* inclined downward as it extends forward from the front end of the protrusion 311*a*. The microphone hole 312 may be provided in a pair in the inclined portion 311*b*, and the microphone module 33 may be mounted on a rear surface of the inclined portion 311*b* and may include a microphone substrate 331 and a microphone element 332, which are mounted to be spaced a predetermined interval from each other on the microphone substrate 331.

A hinge cover 60' may be disposed on the top surface of the cabinet, and the hinge cover 60' may include a front portion, a top surface portion that is bent to extend backward from an upper end of the front surface portion, and a recessed portion 66 defining a space, into which the speaker device 50 is accommodated, by recessing at least a portion of the top surface portion. The recessed portion 66 may be disposed to be biased to one side from a center of the hinge cover 60' in the left and right direction.

The hinge cover 60' may include a cover portion that is disposed in front of one side, which is adjacent to the microphone mounting portion 311, of both sides of the speaker device 50, and is disposed at a height corresponding to a vertical height of the top surface portion may be provided.

As described above, according to an embodiment, the speaker device may be disposed on the top surface of the refrigerator, and the microphone module may be disposed on the top surface of the door to prevent the microphone module from interfering by sound output from the speaker device, thereby improving voice recognition performance.

According to an embodiment, even when the sound is output from the speaker, the user may input a voice through the microphone module to control various operations of the refrigerator, thereby improving user convenience.

In an embodiment, the refrigerator 1 provided with the microphone module 33 and the speaker devices 50 has been described as an example, but is not limited thereto.

The microphone module 33 and the speaker device 50 may be applied to other home appliances in addition to the refrigerator. The home appliance may include a cabinet defining a storage space and a door opening and closing a front surface of the cabinet. For example, the home appliance may be any one of a refrigerator, an air conditioner, a dishwasher, a clothing manager, a washing machine, or a cooking appliance.

For example, the home appliance may include a cabinet defining a storage space, a door opening and closing the storage space, a microphone mounting portion 311 which is provided on a top surface of the door, on which a microphone module 33 receiving a user's voice command is mounted, and in which a microphone hole 312 is defined, a speaker device 50 disposed on a top surface of the cabinet and including an sound output portion 54 that outputs sound. The microphone mounting portion 311 may be disposed at a position at which a center thereof is biased to one side from a center in a left and right direction of the cabinet, and the speaker device 50 may be disposed at a position at which a center thereof is biased to the other side from the center of the cabinet in a left and right direction.

Although the embodiments are exemplified with respect to the accompanying drawings, those having ordinary skill in the art to which the present invention pertains will be understood that the present invention can be carried out in other specific forms without changing the technical idea or essential features.

In addition, although explaining the embodiments of the present invention and explaining the operation and effect according to the constitution of the present invention have not been explicitly described, it is needless to say that a predictable effect is also recognized by the constitution.

The home appliance according to the proposed embodiment may expect the following effects.

According to the embodiment, the sound output unit from which the sound source is output may be disposed to be inclined upward. Thus, there may be the advantage in that, since the sound output from the speaker device is directed upward to improve the phenomenon of being blocked by a door or adjacent furniture.

The speaker device may be disposed on the top surface of the refrigerator, and the position fixing portion may be disposed in the space between the speaker device and the hinge device. Thus, there may be the advantage in preventing the speaker device from moving away from the mounted position due to the external impact such as opening or closing the door.

The position fixing portion may allow the speaker device to be spaced upward from the top surface of the refrigerator. Therefore, the speaker device may minimize the influence of the vibration caused by the refrigeration cycle device or the like. Thus, the damage of the speaker device due to the vibration or the like may be minimized to improve the quality of the sound output from the speaker device.

The speaker device may be connected to the external device. Therefore, the speaker device may be controlled without directly manipulating the speaker device to improve the user convenience.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An appliance comprising:

a cabinet that defines a storage space;

a door configured to open and close at least a portion of the storage space;

a hinge cover that is disposed at a top surface of the cabinet; and a speaker disposed at the top surface of the cabinet and configured to communicate with an external device, the speaker comprising:

a sound output portion that is inclined with respect to the top surface of the cabinet and configured to output sound, a case that is disposed at the hinge cover and defines a space accommodating the sound output portion, and a position fixing portion coupled to sides of the case, wherein the hinge cover comprises:

a front surface portion, a top surface portion that extends rearward from an upper end of the front surface portion, and a recessed portion that is recessed downward from a portion of the top surface portion and defines a space accommodating the case, and wherein the sound output portion is spaced apart from the recessed portion by the position fixing portion.

2. The appliance according to claim 1, wherein the case defines a sound output hole at a position facing the sound output portion.

3. The appliance according to claim 2, wherein the sound output portion is inclined in a direction away from a front surface of the case such that one of an upper end or a lower end of the sound output portion is disposed away from the front surface of the case relative to the other of the upper end or the lower end of the sound output portion.

4. The appliance according to claim 3, wherein the sound output hole defines a plane inclined in a direction away from the front surface of the case such that one of an upper end or a lower end of the sound output hole is disposed away from the front surface of the case relative to the other of the upper end or the lower end of the sound output hole.

5. The appliance according to claim 1, further comprising hinge devices that are disposed at sides of the top surface of the cabinet and rotatably couple the door to the cabinet, and wherein the speaker is disposed between the hinge devices and spaced apart from the hinge devices.

6. The appliance according to claim 5, wherein the position fixing portion is disposed between the speaker and at least one of the hinge devices.

7. The appliance according to claim 6, wherein the position fixing portion defines an opening that faces the speaker and receives at least a portion of the speaker, and wherein the position fixing portion is in contact with a surface of one of the hinge devices.

8. The appliance according to claim 2, wherein the case comprises:

a first case that defines at least a portion of a top surface of the case; and a second case that is disposed below the first case and coupled to the first case, the second case defining at least a portion of a bottom surface of the case.

9. The appliance according to claim 8, wherein the sound output hole is defined at a front surface of the first case.

10. The appliance according to claim 1, further comprising a microphone mounting portion disposed at a top surface of the door and configured to support a microphone module, the microphone mounting portion defining a microphone hole, wherein the microphone mounting portion and the speaker are spaced apart from each other in a left-right direction.

11. The appliance according to claim 10, wherein the microphone mounting portion is disposed at a first side of a center of the cabinet in the left-right direction, and wherein the speaker is disposed at a second side of the center of the cabinet in the left-right direction, the second side being opposite to the first side.

12. The appliance according to claim 10, wherein the door is one of a left door disposed at a left side of the cabinet or a right door disposed at a right side of the cabinet, wherein the microphone mounting portion is disposed at a top surface of one of the left door or the right door, and wherein a center of the speaker is disposed closer to the other of the left door or the right door.

13. The appliance according to claim 12, further comprising hinge devices that are disposed at sides of the top surface of the cabinet and rotatably couple the left door and the right door to the cabinet, wherein the speaker is disposed between the hinge devices and spaced apart from the hinge devices, and wherein the microphone mounting portion is disposed closer to one of the hinge devices coupled to the one of the left door or the right door than to a space between the left door and the right door.

14. The appliance according to claim 10, wherein the microphone mounting portion is disposed closer to a front end of the door than to a rear end of the door.

15. The appliance according to claim 10, wherein the door is one of a left door disposed at a left side of a center of the cabinet in the left-right direction or a right door disposed at a right side of the center of the cabinet, wherein the microphone mounting portion is disposed at the left door, and wherein a center of the speaker is offset to the right side from the center of the cabinet in the left-right direction.

16. The appliance according to claim 10, wherein the microphone mounting portion comprises:

a protrusion that protrudes upward relative to the top surface of the door; and an inclined portion that is inclined with respect to the top surface of the door and extends forward from a front end of the protrusion and downward to the top surface of the door, and wherein the inclined portion defines a pair of microphone holes including the microphone hole.

17. The appliance according to claim 10, wherein the hinge cover further comprises a cover portion that is disposed at a front of one side of the speaker adjacent to the microphone mounting portion, and wherein a height of the cover portion corresponds to a height of the top surface portion in a vertical direction.

18. The appliance according to claim 17, wherein the cover portion extends from an end of the top surface portion toward the speaker.

19. The appliance according to claim 17, wherein the cover portion is disposed between a front surface of the speaker and a rear surface of the door, the cover portion being spaced apart from the top surface portion, and wherein the cover portion is a single cover portion of the hinge cover or one of a plurality of cover portions of the hinge cover.

* * * * *